US007987926B2

(12) United States Patent
Nichols et al.

(10) Patent No.: US 7,987,926 B2
(45) **Date of Patent: *Aug. 2, 2011**

(54) TENSION/COLLAR/REAMER ASSEMBLIES AND METHODS

(75) Inventors: Richard A. Nichols, Spring, TX (US); Bruce L. Taylor, Spring, TX (US); Roger Pierce, Houston, TX (US)

(73) Assignee: Strataloc Technology Products LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/785,875

(22) Filed: May 24, 2010

(65) Prior Publication Data

US 2010/0230167 A1 Sep. 16, 2010

Related U.S. Application Data

(63) Continuation of application No. 12/036,648, filed on Feb. 25, 2008, now Pat. No. 7,730,971, which is a continuation of application No. 11/423,495, filed on Jun. 12, 2006, now Pat. No. 7,353,888, which is a continuation-in-part of application No. 10/761,892, filed on Jan. 21, 2004, now Pat. No. 7,059,429.

(60) Provisional application No. 60/442,737, filed on Jan. 27, 2003, provisional application No. 60/721,406, filed on Sep. 28, 2005.

(51) Int. Cl.
*E21B 17/16* (2006.01)

(52) U.S. Cl. ..... 175/57

(58) Field of Classification Search ..... 175/57, 175/320; 285/123.1, 123.5

See application file for complete search history.

(56) References Cited

U.S. PATENT DOCUMENTS

| | | | |
|---|---|---|---|
| 1,792,841 | A | 2/1931 | Stevenson |
| 2,126,075 | A | 8/1938 | Wright |
| 2,814,462 | A | 11/1957 | De Jarnett |
| 2,958,512 | A | 11/1960 | Humphrey |
| 3,047,313 | A | 7/1962 | Bruce |
| 3,062,303 | A | 11/1962 | Schultz |
| 3,167,137 | A | 1/1965 | Humphrey |
| 3,179,188 | A | 4/1965 | De Jarnett |
| 3,195,927 | A | 7/1965 | Kimbrell |
| 3,232,638 | A | 2/1966 | Hollander |
| 3,265,091 | A | 8/1966 | De Jarnett |
| 3,572,771 | A | 3/1971 | Redwine |
| 3,706,348 | A | 12/1972 | Murphey, Jr. |
| 3,955,835 | A | 5/1976 | Farrington |
| 4,278,138 | A | 7/1981 | Rowley et al. |

(Continued)

OTHER PUBLICATIONS

Finger et al, "Development of a system for Diagnostic While Drilling", Society of Petroleum Engineers, Feb. 19-21, 2003, Amsteradm, The Netherlands.

(Continued)

*Primary Examiner* — William P Neuder
(74) *Attorney, Agent, or Firm* — Kenneth L Nash

(57) ABSTRACT

The present invention provides drilling assembles and methods that are especially useful for a bottom hole drilling assembly for drilling/reaming/or other operations related to drilling a borehole through an earth formation. In one embodiment, the drilling assembly utilizes standard drill collars which are modified to accept force transfer sections. In another embodiment, the drilling assembly comprises a tension inducing sub which creates a force that may be used to place the bottom hole assembly or portions thereof in tension. In another embodiment, a reaming assembly is held in tension to provide a stiffer reaming assembly.

15 Claims, 37 Drawing Sheets

U.S. PATENT DOCUMENTS

| | | | |
|---|---|---|---|
| 4,310,059 | A | 1/1982 | Moore |
| 4,460,202 | A | 7/1984 | Chance et al. |
| 4,760,889 | A | 8/1988 | Dudman |
| 4,771,811 | A | 9/1988 | DeCell et al. |
| 4,776,436 | A | 10/1988 | Nenkov et al. |
| 4,905,776 | A | 3/1990 | Beynet et al. |
| 6,145,602 | A | 11/2000 | Kutinsky |
| 6,186,249 | B1 | 2/2001 | Bjornstad |
| 6,230,822 | B1 | 5/2001 | Sullivan et al. |
| 6,899,187 | B1 | 5/2005 | McCarthy |
| 7,059,429 | B2 | 6/2006 | Taylor et al. |
| 7,353,888 | B2 * | 4/2008 | Nichols et al. ..... 175/57 |
| 7,730,971 | B2 * | 6/2010 | Nichols et al. ..... 175/57 |
| 2002/0157895 | A1 | 10/2002 | Dubinsky et al. |

OTHER PUBLICATIONS

Mansure et al, "Interpretation of Diagnostics While Drilling Data", Society of Petroleum Engineers, Oct. 5-8, 2003, Denver, Colorado.

David Chen et al, "Offshore", Society of Petroleum Engineers, Aug. 2001.

* cited by examiner

TENSION/COLLAR/REAMER ASSEMBLIES AND METHODS

This application is a continuation of application Ser. No. 12/036,648, filed Feb. 25, 2008 now U.S. Pat. No. 7,730,971, which is a continuation of U.S. application Ser. No. 11/423,495, filed Jun. 12, 2006, now U.S. Pat. No. 7,353,888, which is a CIP of U.S. patent application Ser. No. 10/761,892, filed Jan. 21, 2004, now U.S. Pat. No. 7,059,429, which claims the benefit of U.S. Provisional Patent Application No. 60/442,737, filed Jan. 27, 2003, and wherein U.S. application Ser. No. 11/423,495, filed Jun. 12, 2006, now U.S. Pat. No. 7,353,888, also claims benefit of U.S. Provisional Patent Application No. 60/721,406, filed Sep. 28, 2005.

TECHNICAL FIELD

The present invention relates generally to drilling wellbores for oil, gas, and the like. More particularly, the present invention relates to assemblies and methods for improved drill bit and drill string performance.

BACKGROUND ART

Due to their size and construction, prior art heavy weight drill collars are unbalanced to some degree and tend to introduce variations. Moreover, even if they were perfectly balanced, the heavy weight drill collars have a buckling point and tend to bend up to this point during the drilling process. The result of imbalanced heavy weight collars and the bending of the overall downhole assembly produces a flywheel effect with an imbalance therein that may easily cause the drill bit to whirl, vibrate, and/or lose contact with the wellbore face in the desired drilling direction. The oil and gas drilling industry has long sought and continues to seek solutions to the above problems.

SUMMARY OF THE INVENTION

Accordingly, it is an objective of the present invention to provide an improved drilling assembly and method.

An objective of another possible embodiment is to provide faster drilling ROP (rate of penetration), longer bit life, reduced stress on drill string joints, truer gage borehole, improved circulation, improved cementing, improved lower noise MWD and LWD, improved wireline logging accuracy, improved screen assembly running and installation, fewer bit trips, reduced or elimination of tortuosity, reduced or elimination of drill string buckling, reduced hole washout, improved safety, and/or other benefits.

Another objective of yet another possible embodiment of the present invention is to provide means for transmitting the force from one or a plurality of weight sections which may or may not comprise standard drill collars through threaded connectors to any desired point there below through any number of box/pin connection up to and including placing substantially the entire weight of a plurality of weight sections at the top of the drill bit.

An objective of yet another possible embodiment of the present invention provides a much shorter compression length of the bottom hole assembly with respect to the first order of buckling length to thereby virtually eliminate buckling of the bottom hole assembly and the resulting tortuosity in the hole.

Another objective of yet another possible embodiment of the present invention is to provide an outer steel sleeve for the bottom hole assembly which is held in tension instead of being in compression even at close distances from the drill bit such that buckling of the drill string is eliminated.

Another objective of yet another possible embodiment of the present invention is to apply an increased amount of weight adjacent the bit and to permit increased revolutions per minute (RPM) of the drill string to thereby increase the drilling rate of penetration (ROP) in many formations.

Another objective of yet another possible embodiment of the present invention may comprise combining one or more or several or all of the above objectives with or without one or more additional objectives, features, and advantages.

These and other objectives, features, and advantages of the present invention will become apparent from the drawings, the descriptions given herein, and the appended claims. However, it will be understood that the above-listed objectives, features, and advantages of the invention are intended only as an aid in understanding aspects of the invention, and are not intended to limit the invention in any way, and therefore do not form a comprehensive or restrictive list of objectives, and/or features, definitions, and/or advantages of the invention.

Accordingly, a method is provided for drill collars utilized in a bottom hole assembly for drilling oil and gas wells. The drill collars may be standard drill collars commonly utilized in drilling operations for decades and may comprise threaded connections on opposite ends thereof for interconnection to form the bottom hole assembly. The method may comprise installing a plurality of slidable force transfer members within a plurality of drill collars such that the plurality of force transfer members are operable for transferring a force through each of the plurality of threaded connections for applying the force to the drill bit during drilling of the borehole while holding one or more of the plurality of tubulars in tension with the drill pipe string during the drilling of the borehole. The method might further comprise producing the force with a tension inducing sub secured to the bottomhole assembly so that the tension inducing sub producing the force for application to the plurality of force transfer members.

Various embodiments of a tension inducing sub for use with a drilling assembly are also taught. The tension inducing sub may comprise one or more elements such as, for instance, a tubular housing, a threaded connection for the tubular housing for connecting to the plurality of threaded tubulars, a force transfer assembly mounted in the tubular housing for transferring a force through the threaded connection to the plurality of force transfer elements, and a mechanism for creating the force. In one embodiment, the mechanism might further comprise a plurality of gears arranged to provide a mechanical advantage such that a smaller force induced in a first gear is magnified by the mechanical advantage to produce the force.

The present invention may also be embodied within a reamer assembly for enlarging a borehole which may comprise a housing, one or more reamer blades extendable radially outwardly to engage the borehole to be enlarged, one or more force transfer members slidably mounted within the tubular housing, at least one threaded connection for the housing, one or more force creation members for connection to the threaded connection, the one or more force creation members comprising one or more force transfer members operable for transferring a force through the at least one threaded connection to the one or more force transfer members slidably mounted within the tubular housing. The reamer might further comprise a plurality of weight sections as the force creation members, i.e., the force of weight. The plurality of weight sections comprise weight sections threadably mounted above and below the reamer. The reamer might further comprise a bit wherein the force is transferred to the bit through the one or more force transfer members so as to be operable for stiffening the reamer housing by placing the reamer housing in tension while the borehole is being enlarged.

BRIEF DESCRIPTION OF DRAWINGS

For a further understanding of the nature and objects of the present invention, reference should be had to the following detailed description, taken in conjunction with the accompanying drawings, in which like elements may be given the same or analogous reference numbers and wherein.

While the present invention will be described in connection with presently preferred embodiments, it will be understood that it is not intended to limit the invention to those embodiments. On the contrary, it is intended to cover all alternatives, modifications, and equivalents included within the spirit of the invention.

GENERAL DESCRIPTION AND PREFERRED MODES FOR CARRYING OUT THE INVENTION

Figure 1:
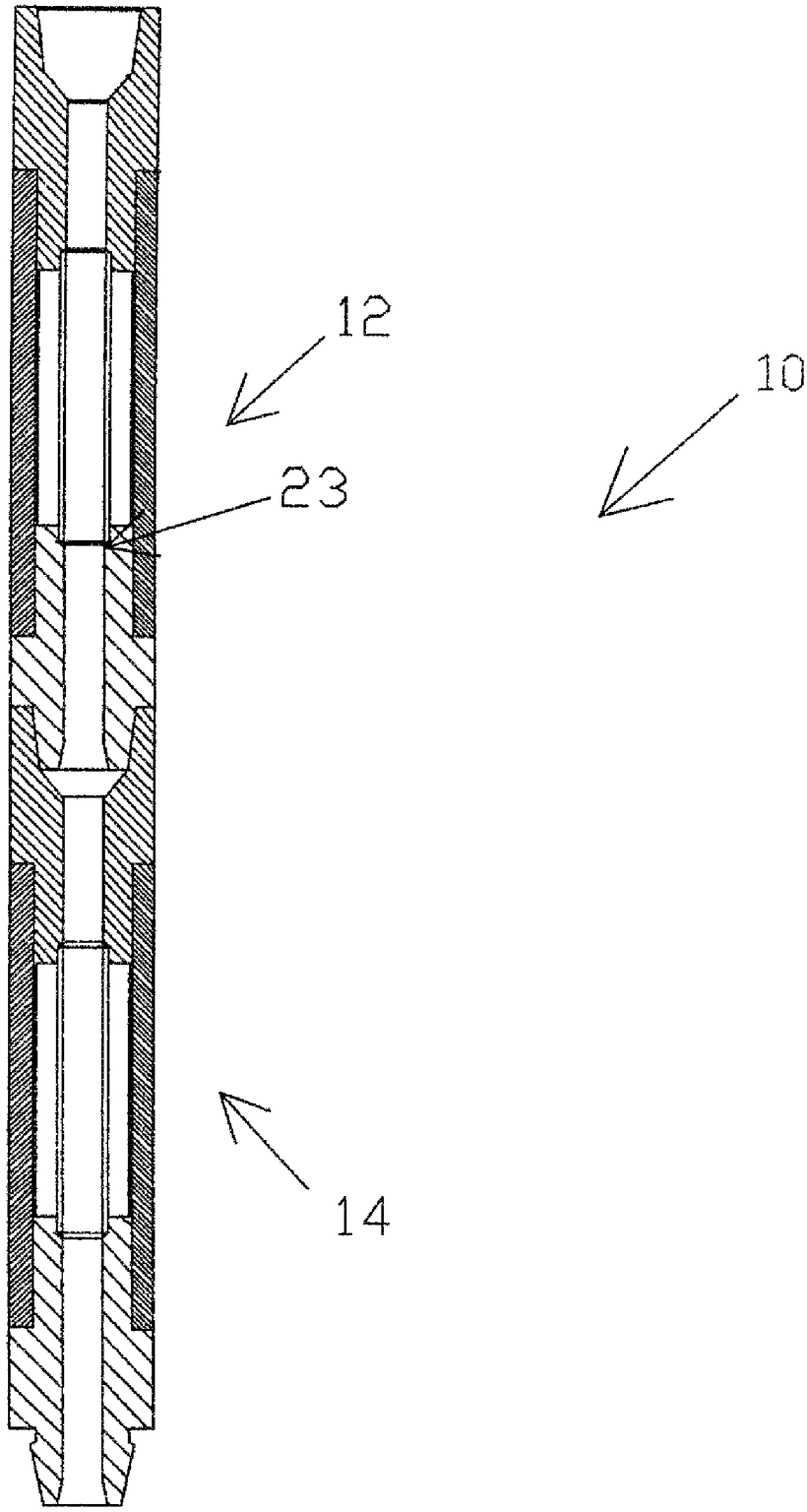
FIG. 1 is an elevational view, in cross-section, of heavy weight drill collars having high density sections in accord with one possible embodiment of the present invention.
Figure 1A:
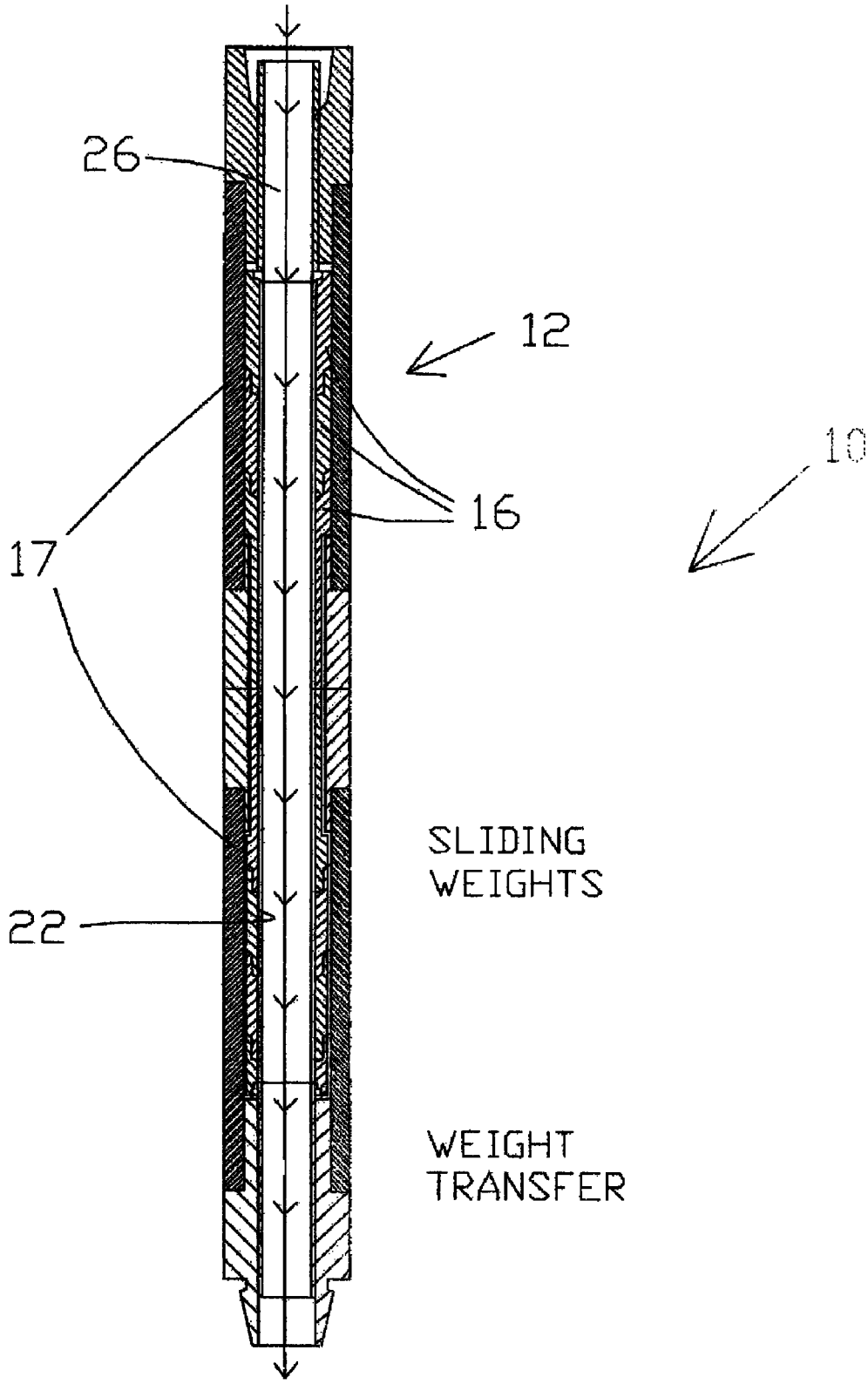
FIG. 1A is an enlarged elevational view, in cross-section, of the upper assembly 12 of FIG. 1 in accord with the present invention.
Figure 1B:
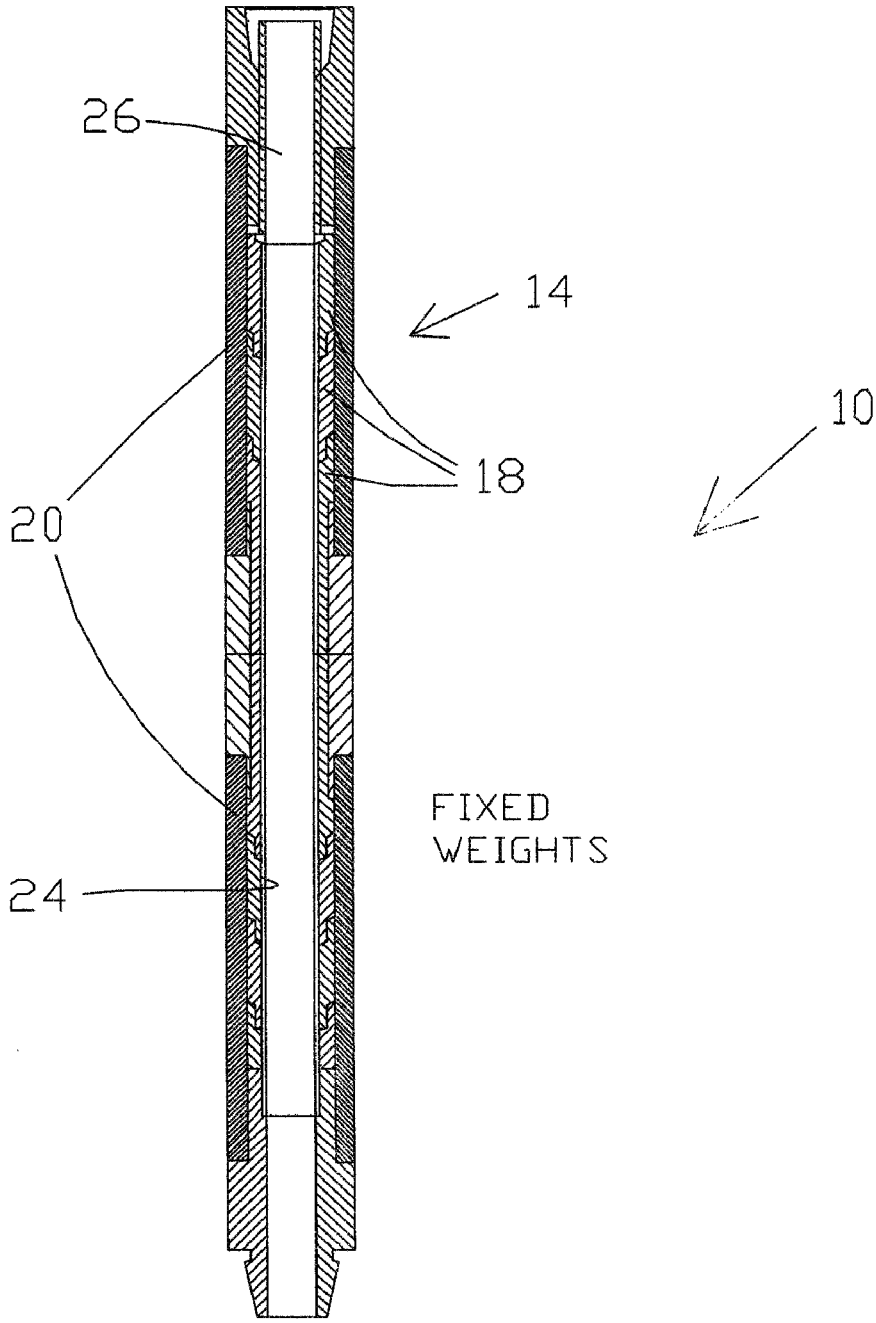
FIG. 1B is an enlarged elevational view, in cross-section, of the lower assembly 14 of FIG. 1 in accord with the present invention.

Now referring to the drawings, and more particularly to FIG. 1, FIG. 1A, and FIG. 1B, there is shown an elevational view of one possible construction of a portion of a drilling assembly 10 which may be utilized in a drill string in accord with the present invention. Drilling assembly 10 may preferably be utilized as a portion of a bottom hole drilling assembly but may also be used elsewhere in the drill string as desired. In FIG. 1, upper section 12 and lower section 14 may be the same or may be significantly different in construction. Upper section 12 is connected to lower section 14 through sub 23. FIG. 1A shows one possible construction for upper heavy weight assembly 12 and FIG. 1B shows a possible construction for lower heavyweight assembly section 14. In the particular embodiments shown in FIG. 1A and FIG. 1B, upper assembly portion 12 and lower assembly portion 14 function differently as discussed hereinafter and may be utilized separately or in conjunction with each other. For instance, multiple upper assembly portions 12 may be threadably connected and stacked together if desired for transferring force through each assembly 12 closer to the drill bit. Alternatively, lower assembly portions 14 may preferably be stacked together to increase the weight of a bottom hole assembly.

In general operation of assembly 12 shown in FIG. 1A, inner sections, such as 16, are moveable with respect to outer sections, such as 17, to supply weight or force to the drill bit during drilling while simultaneously maintaining the outer sections 17 in tension. In comparison with the embodiment of FIG. 1B, in general operation of assembly 14 shown in FIG. 1B, inner sections 18 are not moveable with respect to outer section 24. One preferred embodiment for a bottom hole drilling assembly would utilize multiple stacked assemblies similar to assembly portion 12 which are threaded together and/or multiple stacked assemblies similar to assembly portion 14 which are in the bottom hole assembly to replace standard heavy weight steel drilling collars. Thus, assemblies 12 and 14 may be utilized independently of each other and may or may not be utilized together.

In upper assembly 12, high density section 16 is slidably mounted with respect to outside tube 17. In a preferred embodiment high density section 16 may comprise tungsten alloy as discussed hereinafter. Some benefits of the present invention may also be obtained using other high density materials such as, for example only, heavy metals, steel, depleted uranium, lead, molybdenum, osmium, and/or other dense materials. If desired, section 16 may utilize lighter weight materials to transfer force through assembly 12. However, in a preferred embodiment significant force on the bit is created by weight of multiple high density sections 16 as taught herein.

Because the weight or force associated with high density section 16 is preferably transferred to a lower sub rather than to outside tube 17, outside tube 17 and/or other outside tubes are not necessarily compressed by the weight of high density section 16. Instead tube 17 is more likely to be placed into tension depending on its relative position in the bottom hole assembly, thereby stiffening the bottom hole assembly. As discussed in more detail hereinafter, the present invention permits that a large percentage of the compression length of the bottom hole assembly (that portion of the bottom hole assembly in compression) may be reduced, as indicated graphically in FIG. 5A-FIG. 5C and FIG. 7A-FIG. 7C by use of drilling assemblies in accord with the present invention such as upper assemblies 12 and/or lower assemblies 14. The reduced compression length of the bottom hole assembly results in a stiffer assembly that rotates with less vibration and reduced or eliminated buckling-flywheel effects. The stiffer drill string can then be rotated faster and will drill a cleaner, truer, bore hole, with an increased drilling rate of penetration (ROP).

In another embodiment of the invention, as discussed in FIG. 3A-FIG. 3E, all or practically all and/or selectable lengths of the outer tubulars in the bottom hole assembly of the drill string are in tension. By drastically reducing the compression length of the bottom hole assembly as compared to the buckling point thereof, buckling of the bottom hole assembly is essentially eliminated. In the embodiments of FIG. 3A-FIG. 3E, the weight of preferred high density elements, such as tungsten alloy sections, may be transmitted through the interconnection joints to any number of other lower sections and even down to the top of the drill bit. Thus, the unbalanced flywheel effects caused by buckling of the bottom hole assembly during rotation of the drill string are substantially reduced or completely eliminated.

Drilling assemblies 12 and 14 of the present invention may comprise smaller, shorter, components than the standard 31 foot long steel heavy weight collars. Therefore, assembly section 12 and 14 can be machined or adjusted or weighted to be dynamically and statically balanced as discussed hereinafter to further reduce or eliminate all flywheel effects. The stiff, balanced bottom hole assembly will drill smoother and straighter with reduced bit whirl. As will be discussed hereinafter, a bottom hole assembly built utilizing the balanced, stiff, concentric, high weight subassemblies thereof such as drilling assembly 12 and 14, can be rotated faster. The greater balance, concentricity, increased vibration characteristics, and possibly decreased surface volume for contacting the borehole wall decreases drill string torque or resistance to the rotation of the drill string as compared to standard bottom hole drilling assemblies. ROP is often directly related to the RPM of the drill string so that doubling the drilling RPM may also double the rate of drilling penetration.

In many oil and gas fields that the rate of penetration (ROP) is also directly proportional to the weight on the bit, so that doubling the actual weight on the bit after buoyancy effects are taken into consideration may double the drilling rate of penetration.

In a preferred embodiment for a bottom hole assembly in accord with the present invention, the concentration of weight or force applied to the bit at a position near the bit significantly prevents lateral vibrational movement of the bit due to the increased force required to overcome the greatly increased inertia of the concentrated mass at the bit. Thus, bit whirling is significantly dampened or prevented resulting in a truer bore hole and faster ROP. Other vibrational effects such as bit bounce are also reduced by the elasticity and noise dampening effects of the preferred high density material utilized as discussed hereinafter. While the prior art has concentrated largely on bit design to eliminate bit whirling, bit bounce, and tortuosity, it is submitted by the present inventors that these problems are much better eliminated by the design of the bottom hole assembly tubulars as taught herein.

In the embodiment of the invention shown in FIG. 1B, assembly 14 may comprise high density section 18 which may be securely affixed to outside tube 20. Thus, in assembly 14 inner section 18 is not moveable with respect to outside tube or wall 20. One preferred means of mounting utilizes a shrink fit mounting method whereby close tolerances of the mating surfaces may prevent assembly when the temperatures of the components 18 and 20 are the same, but heating or cooling of one of the component 18 and 20 permits the assembly and provides a very secure fit after the temperature is stabilized. For instance, outside tube 20 may be heated to a high temperature, e.g., up to about 450 degrees Fahrenheit, thereby expanding. High density section 18, which has approximately the same dimension and cannot fit at equalized temperatures, may then be inserted into outside tube due to the expansion caused by a significant temperature difference. When both outside tube 20 and high density section 18 are the same temperature, then the components are held fast to each other. Note that as explained below, the high density material may preferably comprise a tungsten alloy which is designed to have similar tensile strength and elasticity as steel. Thus, the combined assembly has similar mechanical properties as standard steel heavy weight collars but has a weight almost twice that of a standard steel heavy weight collar. In heavier muds, the combined assembly may have an actual applied weight on the bit after buoyancy effects that is more than twice that of the same length of standard steel heavy weight collars. (See FIG. 6A and FIG. 6B)

In the above described designs, wash pipes or inner tubulars 22 and 24 are preferably utilized on the inside of high density sections 16 and 18 to protect and preserve high density sections 16 and 18. Thus, high density sections 16 and 18 are preferably contained between inner and outer tubulars such as steel tubulars rather than exposed to circulation flow through bore 26. In a preferred embodiment, high density sections 16 and 18 are also sealed therein to prevent any contact with the circulation fluid. If desired, inner tubulars 22 and/or 24 could also or alternatively be affixed to high density sections 16 and 18 by assembling when there is a significant temperature difference that provides just enough clearance for assembly whereby after the temperatures of the components are approximately the same, the components are affixed together.

It is highly advantageous during directional drilling to be able to take a magnetic survey as close to the bit as possible. Typically, one to three hundred feet may need to be drilled before the effects of actions taken by the directional driller can be seen due to the need to keep the compass away from the magnetic bottom hole assembly. This results in sometimes getting off target and makes corrections to get back on target difficult. In one embodiment of the present invention, a nonmagnetic tungsten alloy may be utilized. In this case, inner and outer tubulars, such as 22 and 20 may comprise a nonmagnetic metal such as Monel. Because the amount of Monel required is significantly reduced as compared to prior art Monel tubulars which are typically utilized for the purpose of making magnetic surveys, the cost for Monel material is also significantly reduced. Moreover, Monel heavyweight drill collars are not normally utilized so that the compass survey data is generally not available adjacent or within the heavy weight drilling collar portion of the drill string. By permitting compass measurements closer to the bit, the drilling accuracy can be significantly improved.

Other constructions of the high density assembly for directional drilling may comprise use of tungsten powder or slurry to provide a readily bendable weight section for use in direction drilling where a stiff bottom hole assembly may cause sticking problems or even be incapable of bending the necessary number of degrees per depth required by the drilling projection. The greater flexibility and heavier weight of a bottom hole assembly in accord with this embodiment of the present invention permits greater weight to be applied to the bit even when using a bent sub with considerable angle. The ability to apply more weight on the bit during directional drilling in accord with the present invention is likely to increase the ROP of directional drilling operations thereby significantly reducing the higher cost of directional drilling. Directional drilling bottom hole assemblies may comprise mud motors, bent subs, and the like. The use of a flexible heavyweight section with this type of directional drilling assembly provides means for improved and faster directional drilling. Moreover, the use of nonmagnetic material within the bottom hole assembly itself gives rise to the potential of placing the compass much closer to the bit than is now possible thereby permitting much more accurate drilling, fewer doglegs, and better producing wells that accurately go through the drilling target or targets along an optimal drilling path with a faster ROP.

In one preferred embodiment, the tensile strength and elasticity of a preferred tungsten alloy are adjusted to be similar to that of steel. One preferred embodiment of the present invention completely avoids use of cobalt within the tungsten alloy to provide greater elasticity of the tungsten alloy. Cobalt has in the past been utilized within a tungsten alloy to increase the tensile strength thereof. However, increasing the tensile strength reduces the elasticity making the tungsten compound brittle. In accord with one embodiment of the present invention, a cobalt tungsten alloy is avoided as being unsuitable for general use in a bottom hole assembly environment when it will be subjected to many different types of stress, e.g., torsional, bending, compressive, and the like, which bottom hole drilling assemblies encounter. A presently preferred embodiment tungsten alloy in accord with the present invention comprises 93-95% W (tungsten), 2.1% NI, 0.9% Fe, and 2-4% MO. This alloy has greater plasticity than prior art tungsten alloys utilized in bottom hole assemblies and is therefore better suited to withstand the stresses created thereby. The components are preferably adjusted to provide mechanical properties similar to that of steel whereby the above formulation is believed to be optimal such that the assembly reacts in many ways as a standard steel collar.

The tungsten alloy has a high mechanical vibration impedance approximately twice that of steel which also limits vibrations in the drill string thereby reducing tool joint failure in the drill string. In one embodiment of the present invention as also discussed in connection with FIG. 8, a transition section comprising tungsten alloy may be utilized between the bottom hole assembly and the drill pipe string, or at any other desired position in the drilling string, to thereby dampen vibrations transmitted from the bottom hole assembly to the drill pipe string. The transition section may be constructed in accord with one of the construction embodiments taught herein and may be positioned between the bottom hole assembly and the drill pipe string.

Figure 2:
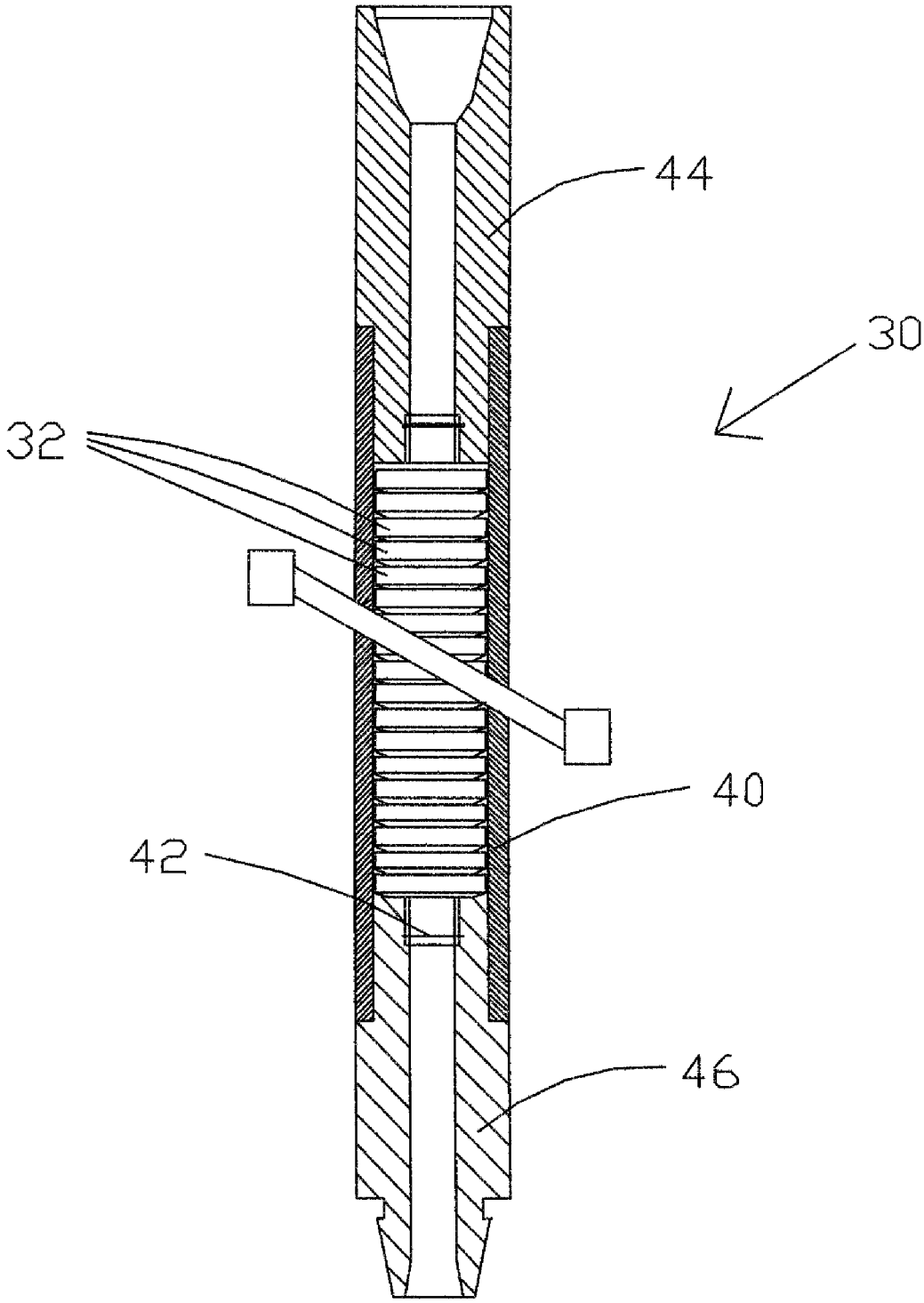
FIG. 2 is an elevational view, in cross-section, of a heavy weight drill collar having a high density section in disks in accord with one possible construction of the present invention.

FIG. 2 shows one possible construction of drilling assembly 30 in accord with one embodiment of the present invention utilizing a plurality of tungsten elements 32 stacked in mating relationship with each other. The dimensions of each tungsten element 32 are preferably tightly controlled to provide that drilling assembly 30 is balanced. Likewise, the dimensions of outer tubular 40, upper section 44, and lower section 46 are also tightly controlled. The length of assembly 30 may be approximately half that of a standard drill collar. Each element is small enough so that dimensions can be tightly controlled during machining. If any static or dynamic imbalance were detected, then a specially weighted tungsten element 32 may be utilized and inserted at a desired rotational and axial position, and fixed in position to thereby correct the imbalance. During assembly in one preferred embodiment, tungsten elements 32 are preferably inserted into outer tubular 40 when there is a large temperature difference. The dimension tolerances are selected so that only when there is a significant temperature difference is it possible to insert weighted tungsten elements 32 into outer tubular 40. When the temperature is approximately the same, the relative expansion/contraction of the components will result in a very tight and secure fit.

Drilling assembly 50 may be utilized to transfer force such as the force of the weight of heavy metal, steel, tungsten, depleted uranium, lead, and/or other dense materials from upper positions in bottom hole assembly to lower positions in the bottom hole assembly.

Figure 3A:
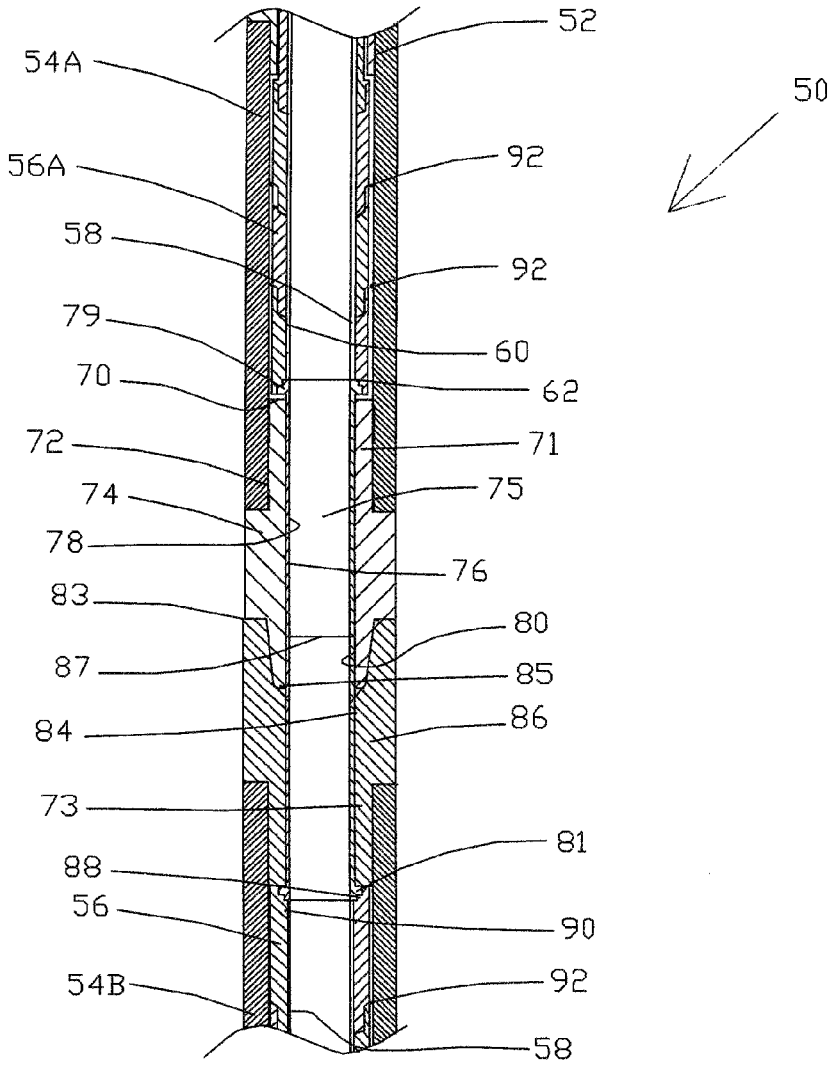
FIG. 3A is an elevational view, in cross-section, of a heavy weight drill collar with multiple high density inner sections with weight transmitting elements wherein all of the high density weight is transferred through the center of the tool for application directly to the top of the drill bit while the outer steel sheath is in tension in accord with the present invention.

FIG. 3A shows an internal construction of a portion of drilling assembly 50. Drilling assembly 50 may comprise many sections as shown in FIG. 3A which are threadably connected together, as are standard drill string tubulars, which transfer force such as force created by weight through the assembly and through the threaded connectors.

Figure 3B:
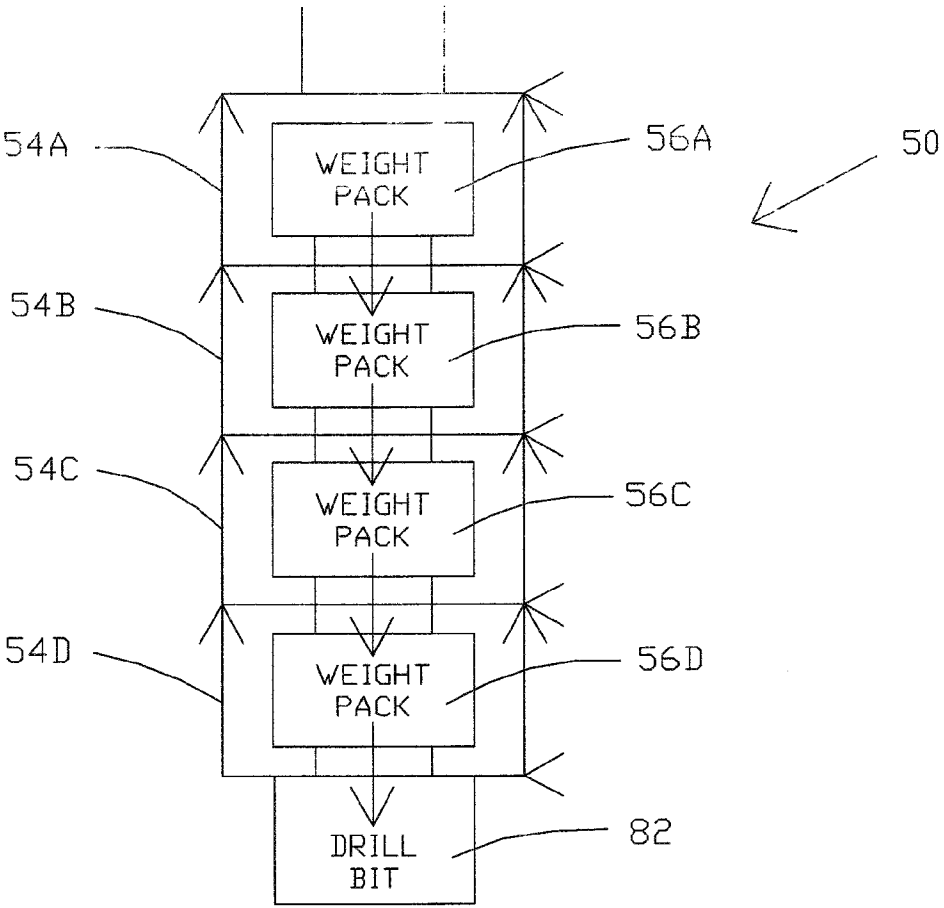
FIG. 3B is a schematical view showing tension and compression forces in one preferred embodiment of the present invention as per FIG. 3A wherein the gravitational force produced by tungsten alloy weight sections is transmitted directly to the bit or bit connection sub through the interior of the tool.

FIG. 3B schematically shows one possible basic mode of operation of weight transfer drilling assembly 50. Drilling assembly 50 may comprise any number of high density heavy weight section collars constructed from outer tubulars 54A-54D and moveable weight packs 56A-56D supported therein. The weight or force acting on or created within each weight pack may be collectively transferred to the next lower weight pack through the tool joints. Preferably, the high weight packs 56A-56D may comprise tungsten alloy but the slidable weight packs could comprise any material, including lower density materials, which are suitable to provide a desired weight for a particular application. Each high density weight pack 56 is interconnected by rods/tubes/or other means to thereby transmit the weight downwardly in the bottom hole assembly through a plurality of threaded connections that connect the tubulars as do standard drill string tubulars and may even transfer all weight directly to bit 82. In a preferred embodiment, a large portion or all of the string of outer tubulars 54A-54D is thereby held in tension so that collar buckling of the bottom hole assembly is effectively eliminated. The placement of the collective entire weight of one or more high density weight sections 56A-56D through a plurality of threaded connections directly on the top of bit 82 has the effect of preventing bit bounce because of the significant inertia which must be overcome to cause the bit to move upwardly. The high vibration absorbing properties of tungsten alloy in accord with the present invention also reduce the tendency of drill bit 82 to vibrate upwardly. Drill bit 82 is therefore held to the face of the formation for smoother, faster, drilling.

The ability to hold the bit face in contact with the bottom of the bore greatly increases the rate of drilling penetration especially for modern PDC bits. The PDC cutting elements of bits have a very short length and, ideally, must be held in constant contact with the surface to be cut for maximum cutting effects. Thus, a bottom hole assembly in accord with the present invention is ideally suited for maximizing the drilling potential of modern PDC bits.

Figure 4B:
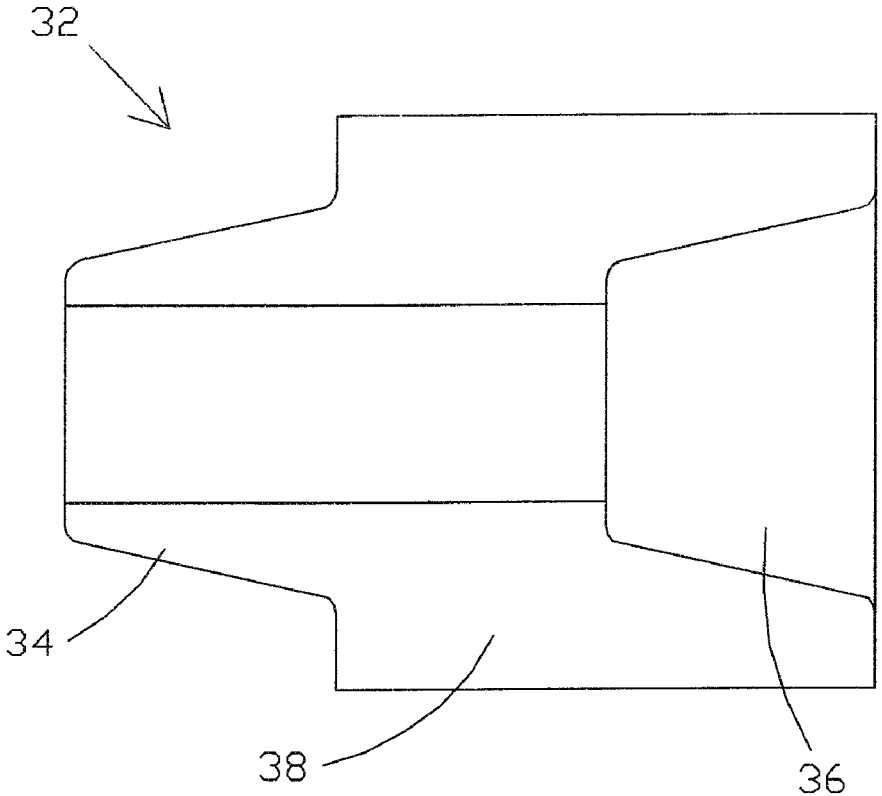
FIG. 4B is an elevational view, in cross-section, showing a tungsten alloy segment that may be utilized in combination to form a weight pack in accord with one embodiment of the present invention.
Figure 4A:
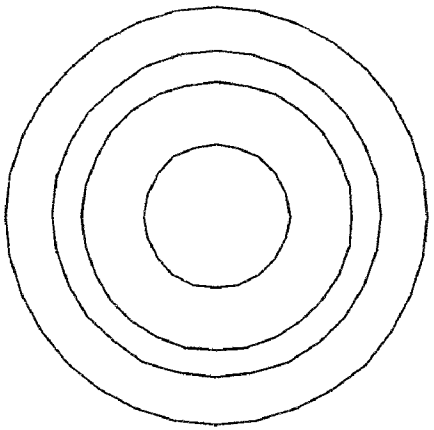
FIG. 4A is an end view of the tungsten alloy segment shown in FIG. 4B in accord with one embodiment of the present invention.

Weight packs 54A and 54B may comprise a plurality of tungsten compound elements 32, an example of which is shown in FIG. 4A and FIG. 4B. In this example, each tungsten element 32 has a pin 34, box 36, and body 38. The tungsten elements are stacked together. The relatively short tungsten elements 32 may be manufactured to very high tolerances to thereby avoid any imbalances. The completed assembly is preferably dynamically and statically balanced. If necessary, any fine tuning balancing may be accomplished utilizing tungsten elements that are weighted to offset the imbalance and positioned axially and fixed in a radial position by tabs, grooves, or the like.

Due to the flexibility of the tungsten compound of the present invention, the relative thickness of tungsten can be made relatively large as compared to the thickness of the outer tubulars such as outer tubular 20, 40, 54A, and so forth in one of the embodiments of the present invention. Thus, the present invention will have a higher density per volume as compared to some prior art devices discussed hereinbefore. For instance, in one presently preferred embodiment it is desirable that the wall thickness of body 38 be at least 25% to 50% greater than the wall thickness of the outer tubular as compared with prior art designs which utilize a thick steel jacket. For the 10.0 inch diameter assembly, which may be utilized for drilling bore holes where a prior art 9.5 inch diameter drill collar was previously utilized, and assuming a 3.5 inch bore through weight section 32 (which may be reduced closer to 2.875 for some situations as per other prior art downhole assemblies), the wall thickness is 2.25 inches as compared to a 1.0 inch wall thickness of the outer tubular. Thus, for this situation the wall thickness of weight section 32 is 125% greater than the wall thickness of the outer tubular.

In a preferred embodiment, pin 34 and box 36 may have a taper of about three to four inches per foot. This structure provides a strong connection between the weight sections 32 that has significant bending resistance thereby producing a stiffer assembly.

Weight sections 32 are stacked together and may be mounted in a shrink fit manner, by compression, or may be moveable axially. In any case, it is presently not considered necessary to provide any threads on the weight sections to interconnect with outer structural tubulars, as has been attempted in the prior art with brittle weighting material.

As shown in FIG. 3A, drilling assembly 50, which is used for force and/or weight transfer through threaded connections, may comprise one or more hollow tubulars such as tubular housing 54A or 54B. One end of each tubular housing 54A and 54B is preferably secured to a pin such as pin portion 71 of pin thread body 74. An opposite end of each tubular housing 54A and 54B may be secured to a pin such as pin portion 73 of box thread body 86. Preferably, pin portion 71 and pin portion 73 utilize the same type of thread for joining multiple tubular housings together within drilling assembly 50. It will be noted that housings such as housing 54A and 54B may comprise multiple tubulars and so be built in selectable lengths. In this case, each tubular forming a housing, such as housing 54A, may be secured with another tubular utilizing sub 52 which preferably comprises a double pin threaded body to thereby form a housing of any size length.

Located inside hollow tubular housings 54A and 54B are weight packs 56A and 56B. As discussed hereinbefore, weight packs 56A and 56B may be made from any suitable material such as heavy metal, steel, depleted uranium, lead, or other dense materials, but are preferably formed of tungsten alloy. Weight packs 56A and 56B may be made in solid form in the form of liquids or powders, e.g., tungsten powder or a tungsten slurry. Preferably, any liquids and powders are placed inside sealed containers to prevent any possible leakage. Weight packs 56A and 56B may be mounted in different ways. When used as part of a weight transfer system as illustrated in FIG. 3A, weight packs 56A and 56B are preferably free to slide up and down for a short axial distance in space 70 but completely prevented from radial movement by suitable means some of which are discussed herein.

In a preferred embodiment, weight packs 56A and 56B are preferably centered within housings 54A and 54B. In one possible embodiment, this may be accomplished by means of centering rings 92. Centering rings 92 are preferably designed to adjust to temperature and pressure changes, allowing diameter compensation for weight packs 56A and 56B in downhole applications. Centering rings 92 permit axial movement of weight packs 56A and 56B. In another embodiment, tabs, fins, grooves, tubulars, or the like could be utilized.

Figure 4D:
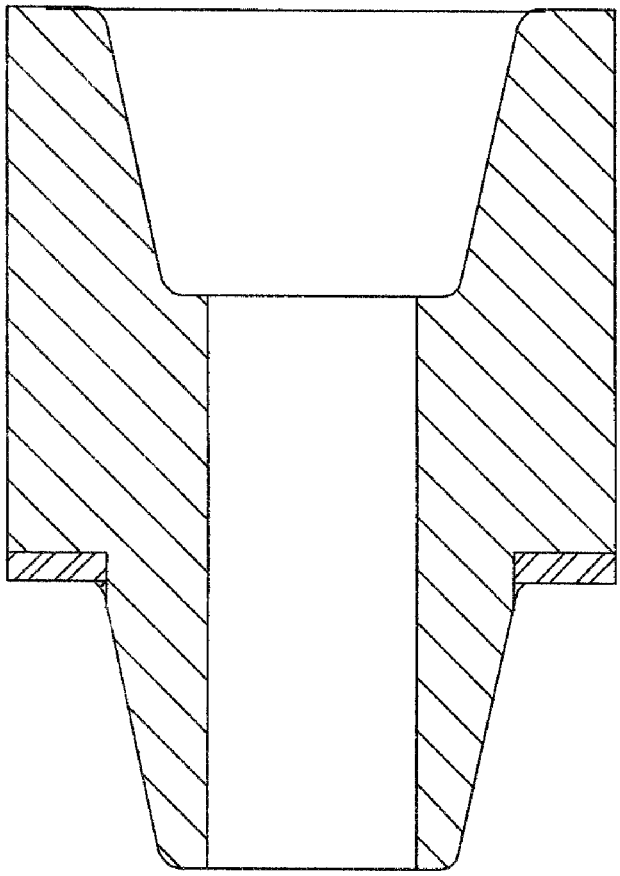
FIG. 4D is an elevational view, in cross-section, showing a tungsten alloy segment with thermal expansion tabs as one possible means for controlling the centering the as temperature changes.
Figure 4C:
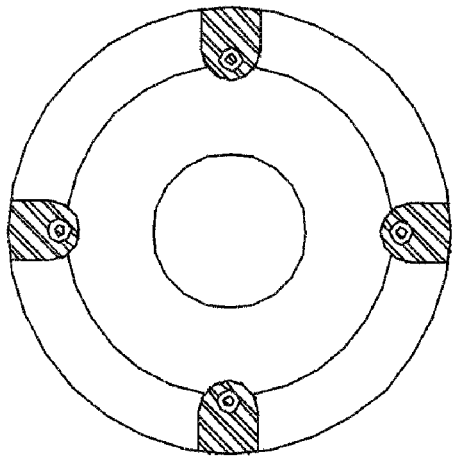
FIG. 4C is an end view of the tungsten alloy segment with thermal expansion tabs shown in FIG. 4D in accord with one embodiment of the present invention

It is not necessary that the centering elements be positioned between the outer surface of the weight packs and the inner surface of the outer tubular. For instance, as shown in FIG. 4C and FIG. 4D in another embodiment, bronze tabs may be bolted onto, for instance, pin 34. Bronze has a higher thermal expansion rate than either steel or tungsten and therefore expands during heat to keep the weight packs centralized within the outer tubular, e.g., with a fixed annular spacing substantially regardless of temperature.

However, weight packs 56A and 56B could also be restrained by shrink fit or placed in the compression between pin and box bodies, if desired. In this case, the drilling assembly would operate more like drilling assembly 14 as discussed hereinbefore.

Preferably, weight packs 56A and 56B are sealed between tubular housings 54A and 54B by wash pipes such as wash pipes 58 (See FIG. 3A) to prevent contact with fluid due to circulation flow through aperture 75 that runs through drilling assembly 50. Wash pipes 58 utilize seal 60 on a lower end thereof and seal 90 on an upper end thereof for sealing off the weight packs. Space 70 and the sealed volume enclosing weight packs 56A and 56B may preferably be filled with a non-compressible fluid for pressure balancing purposes.

In a preferred embodiment, upper transfer tube 78 and lower weight transfer tube 80 are split into two sections and engage each other at connection 87. Other arrangements could also be utilized to connect or avoid the need to connect the weight transfer element, but may require the operators to add components during installation. Thus, this construction allows operators to interconnect the components of the bottom hole assembly in substantially the way that the standard steel heavy weight bottom hole assembly is connected.

Upper weight transfer tube 78 and lower weight transfer tube 80 also utilize seals to prevent fluid leakage to weight packs 56A and 56B. Seal 62 is utilized for sealing the upper end of upper weight transfer tube 78 and seal 76 is utilized for sealing the lower end of upper weight transfer tube 78 with respect to weight packs 56A and 56B. Seal 84 and seal 88 are utilized by lower weight transfer tube 80 for the same purpose.

Upper weight transfer tube 78 and lower weight transfer tube 80 are also axially movable with weight packs 56A and 56B. Upper weight transfer tube 78 and lower weight transfer tube 80 are thereby able to transfer the weight of upper weight pack 56A onto lower weight pack 56B. Upper weight transfer tube 78 comprises upper platform 79, which engages and supports the weight of upper weight pack 56A. The force applied to upper platform 79 is applied to lower platform 81 and the top of weight pack 56B. The weight of each high density section is thereby transmitted downwardly and may even be applied through a bit sub directly to the top of the bit. The outer tubes, such as outer tubes 54A and 54B are held in tension by the relatively axially moveable weight of the weight sections to provide a stiff bottom hole assembly which effectively eliminates buckling. The truer drilling resulting therefrom may eliminate the need for stabilizers in many circumstances to avoid the cost, friction, and torsional forces created due to such use.

While one or more weight transfer tubulars, such as upper transfer tube 78 and lower weight transfer tube 80 are shown in this preferred embodiment as the weight or force transmitting element in this embodiment, other weight or force transmitting elements such as rods or the like may be utilized. As well, the weight or force transmitting elements may extend through apertures other than center bore 75 to connect the weight sections. Therefore, the present invention is not limited to utilizing split tubular force or weight transmission elements as illustrated, although this is a presently preferred embodiment. Force or transfer tubes 78 and 80 provide a relatively simple construction that permits connecting a plurality of heavyweight sections in a typical manner utilizing standard equipment for this purpose.

Figure 3C:
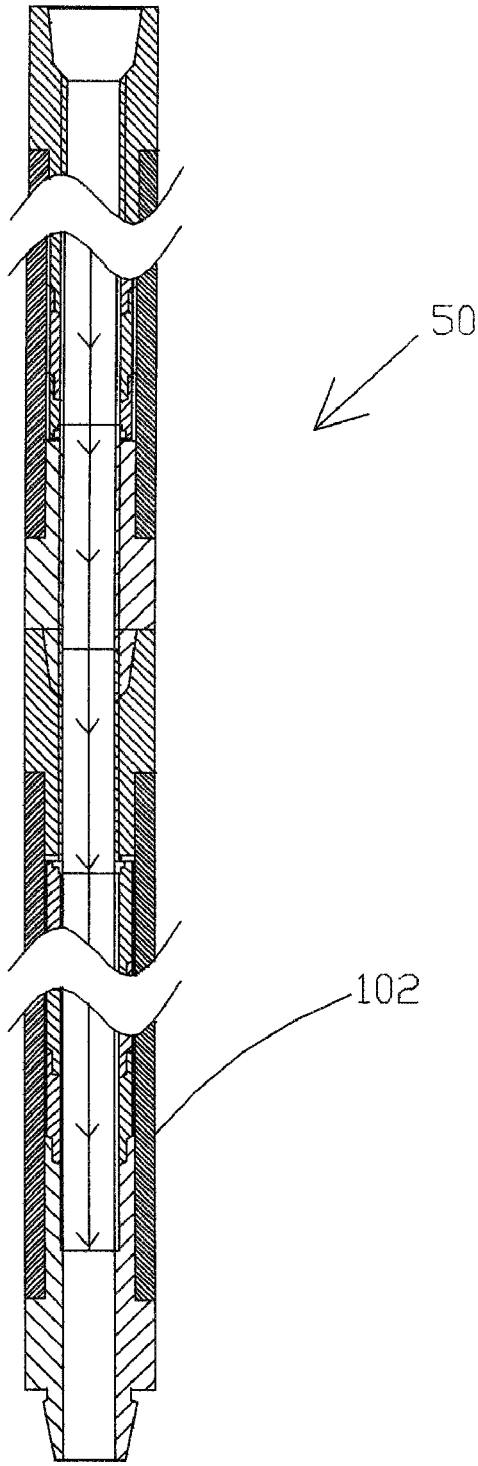
FIG. 3C is an elevational view, in cross-section, of the drilling assembly of FIG. 3A wherein the bottom hole assembly may be in tension within two feet of the drill bit in accord with one embodiment of the present invention.
Figure 3D:
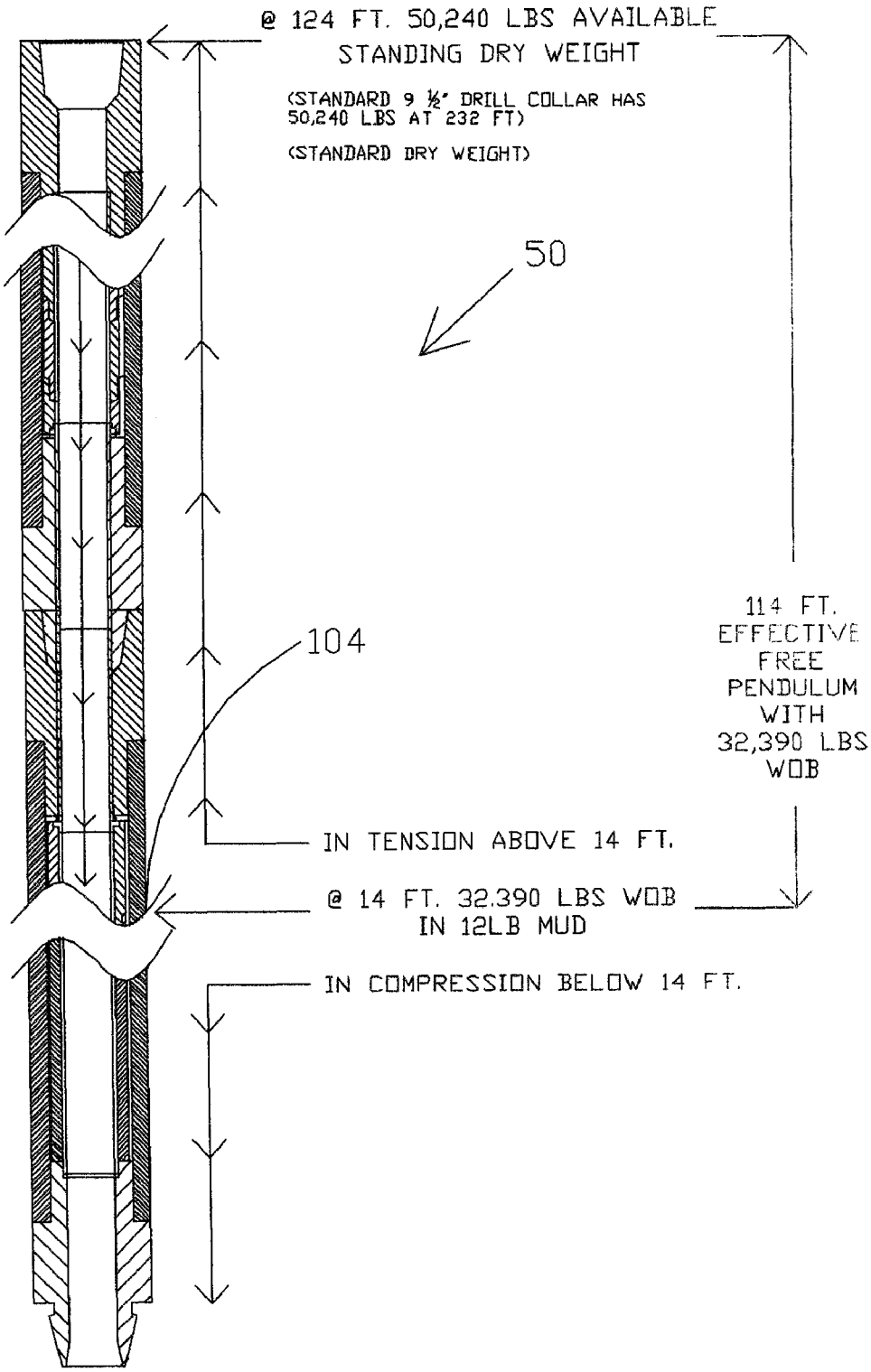
FIG. 3D is an elevational view, in cross-section, of the drilling assembly of FIG. 3A wherein the bottom hole assembly may be in tension within fourteen feet of the drill bit in accord with one embodiment of the present invention.
Figure 3E:
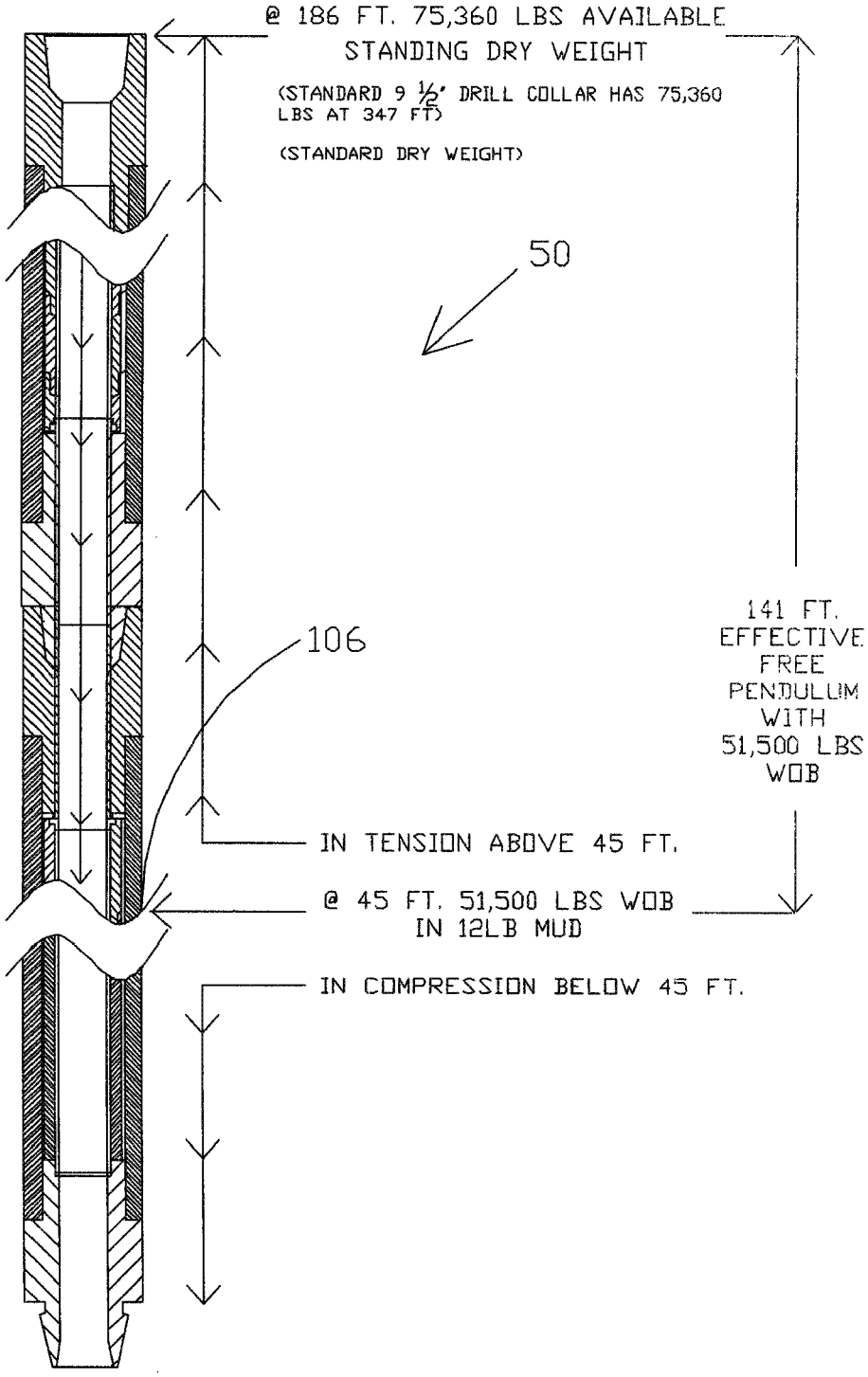
FIG. 3E is an elevational view in cross-section, of the drilling assembly of FIG. 3A wherein the bottom hole assembly may be in tension within forty-five feet of the drill bit in accord with one embodiment of the present invention.
Figure 3F:
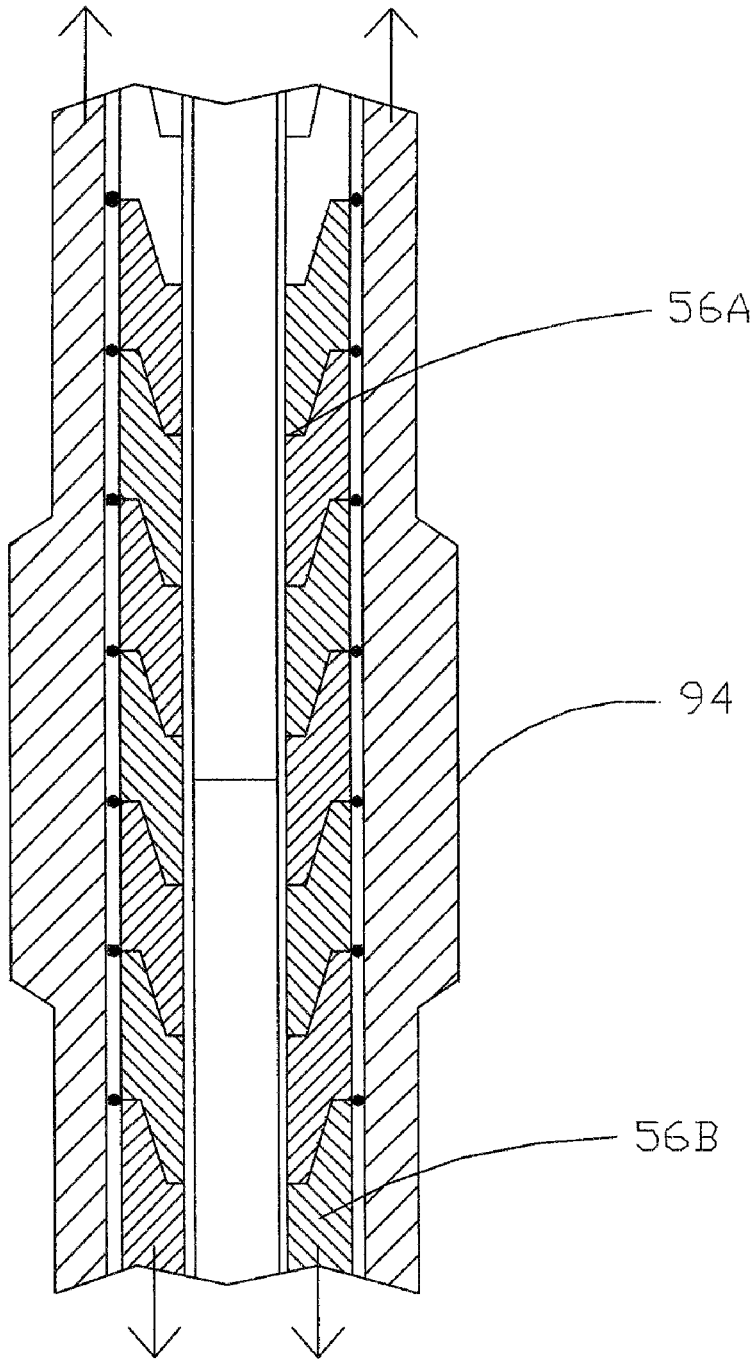
FIG. 3F is an elevational view, in cross-section, showing the transfer of weight through other drill string components such as a stabilizer or weight section with integral stabilizer in accord with the present invention.

It will be noted that the transfer of weight or force is made through a standard threaded pin-box connection 83 which is of the type typically utilized in drilling strings. In accord with the present invention, the force or weight can be transferred through any drill string component as may be desired. For instance, FIG. 3F shows the weight of weight pack 56A being transferred through stabilizer 94. If desired, stabilizer 94 can be built integral or machined in one piece with the outer tubular, thereby eliminating the need for a connection. This construction is difficult or impractical with prior art heavy weight collars that require a separate stabilizer. Due to the component structure of the present invention, it is possible to machine desirable structures such as stabilizer 94 directly into the outer tube. However, stabilizer 94 could also be mounted by other means or clamped on or provided as a separate component.

In one preferred embodiment, an enlarged or bored out aperture through a standard stabilizer permits a weight transmitting tubular to be inserted therein. The bending strength ratio for the pin-box connection has a BSR in the range of approximately 2.5 which is often a desired value to permit equal bending of the box elements and the pin so that neither element is subject to excessive bending stress. Various portions of the pin-box connection can be altered to thereby obtain a desired BSR, e.g., boring out the passageway through the joint. It is often possible to modify many standard drill string components by simply boring out the passageway and still be well within the desired BSR range so that specialized equipment is not required. Thus, the weight transmitting tubular construction may also be utilized to transmit weight or force through any type of drilling element such as stabilizers, bit connection sections, and the like. The straight, unperturbed, continuous wall flow path through tubular weight transfer elements 78 and 80 produces a more continuous bore through the bottom hole assembly to reduce fluid turbulence and associated wear at the pin-box connections, as occurs in prior art heavy weight collar sections. The fluid turbulence and wear reduces the life of prior art heavy weight collar sections as drilling fluid is circulated through the drill string as per standard drilling operation procedures. Thus, the transfer tubular elements 78 and 80 also have the advantageous purpose of actually increasing the reliability pin-box connections as compared to prior art pin-box bottom hole assembly connections.

Figure 7B:
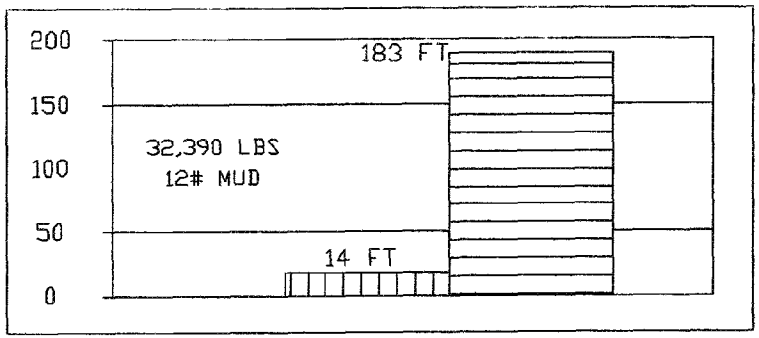
FIG. 7B is a comparison chart showing the bottom hole assembly compression lengths and relationship to the first order of buckling for one embodiment of the present invention as compared to standard drill collars which places the same weight on the drill bit.
Figure 7A:
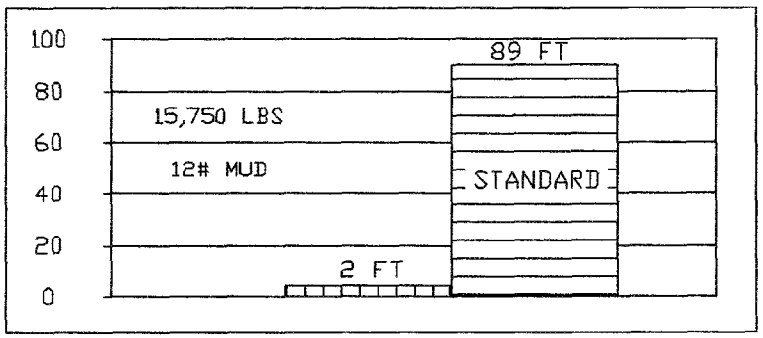
FIG. 7A is a comparison chart showing the bottom hole assembly compression lengths of two feet versus eighty-nine feet for one embodiment of the present invention as compared to standard drill collars which places the same weight on the drill bit.
Figure 7C:
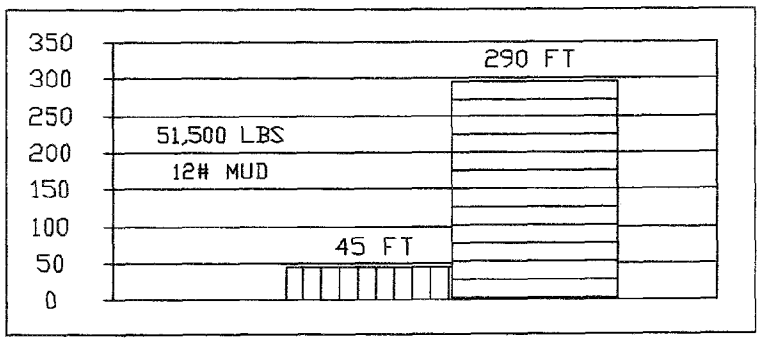
FIG. 7C is a comparison chart showing the bottom hole assembly compression lengths and relationship to the second order of buckling for one embodiment of the present invention as compared to standard drill collars which places the same weight on the drill bit.

Using multiple weight transfer packs, extremely heavy weight can be applied in a very short distance close to the actual bit or working area. FIG. 3C-FIG. 3E show examples of the use of drilling assembly 50 to apply the weight of the weight packs at distances such as two feet above the bit at point 102 in FIG. 3C, fourteen feet above the bit at point 104 in FIG. 3D, and 45 feet above the bit at point 106 in FIG. 3E. Comparison of these values with prior art heavy weight sections are shown in the graphs of FIG. 7A-7C. The outer tubulars above these points are therefore in tension providing for a stiff, concentrically balanced, bottom hole assembly. Many different combinations of the components of the drilling assemblies such as drilling assembly 14 and drilling assembly 50 can be made to add as much weight to the bottom hole assembly in a desirable position for efficient drilling. All this can be done to maximize the weight on the bit and stay far below the buckling points of standard down hole tools.

The use of the present invention eliminates or significantly reduces most of the current problems associated with heavy weight drilling requirements such as bending of the bottom hole assembly, buckling of the bottom hole assembly, pressure differential sticking, broken or damaged thread connections, crooked hole boring or drilling, hole washouts, bent drill pipe, down hole vibrations, bit whirl, drill string whip, drill string wrap (wind-up), drill bit slap-stick, bit wear, bit bounce, and others. With the reduction or elimination of these problems, it is anticipated that increased rates of penetration can be achieved and overall costs significantly reduced.

Figures 5A, 5B, 5C:
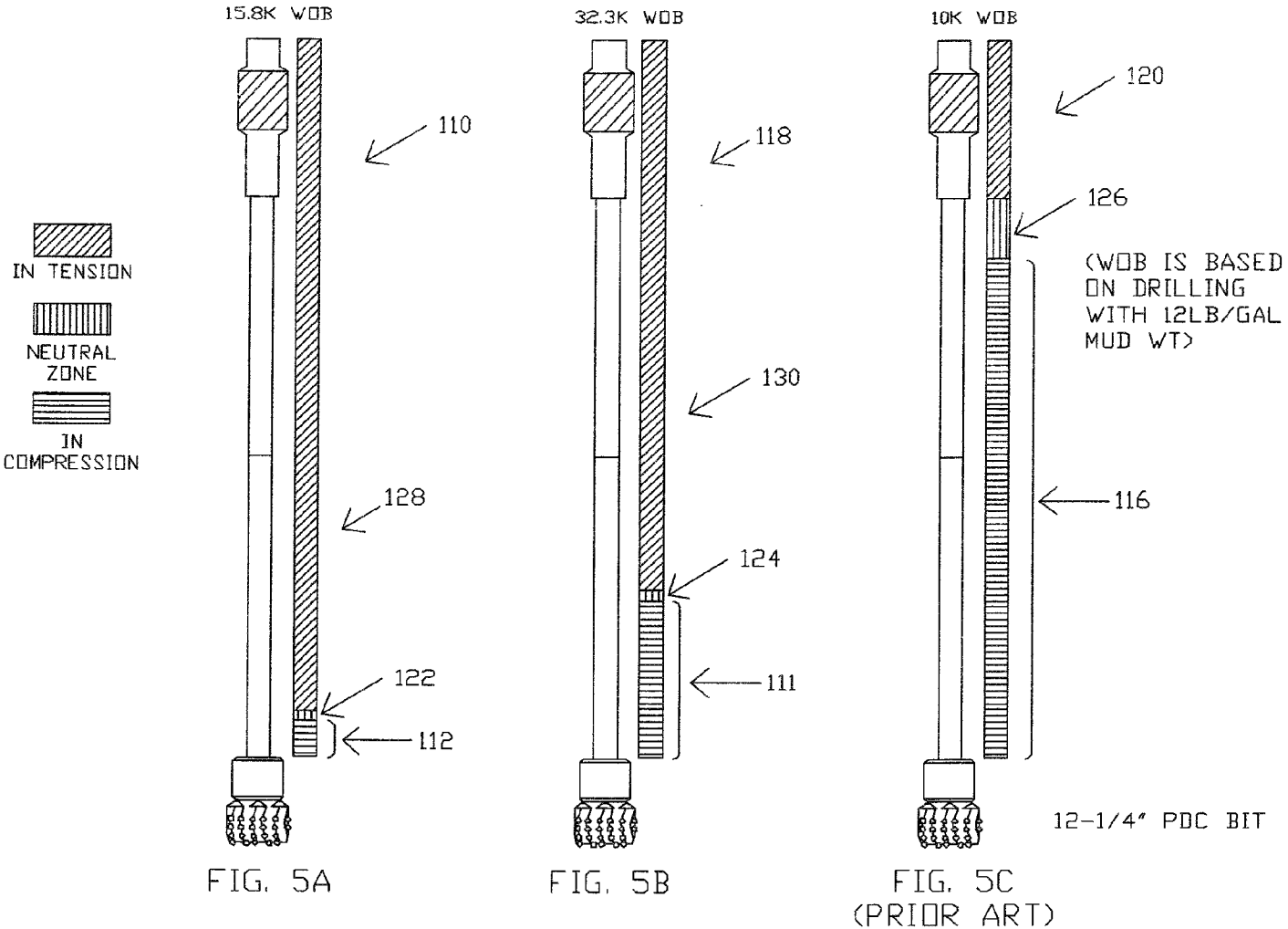
FIG. 5C (PRIOR ART)
FIG. 5A is an elevational view showing a bottom hole assembly in accord with the present invention which shows the concentration of 50% more useable weight on the bit with a very short compression length of the bottom hole assembly than a comparable prior art bottom hole assembly as shown in FIG. 5C.
FIG. 5B is an elevational view showing a bottom hole assembly in accord with the present invention with 300% more useable weight on the bit and a significantly shortened compression length of the bottom hole assembly as compared to the prior art shown in FIG. 5C.
FIG. 5C is an elevational view showing a prior bottom hole assembly for comparison purposes with embodiments of the present invention shown in FIG. 5A and FIG. 5B.

FIG. 5A-FIG. 5C show an embodiment of the present invention which illustrates that the compression length of the bottom hole assembly is adjustable and may be greatly shortened as compared to prior art drilling assemblies. For instance, in FIG. 5A compression length 112 provides about 15.8 thousand pounds weight on the bit in 12 lb./gal mud. The short compression length 112 shown for bottom hole assembly 110 in accord with the present invention is easily comparable visually with the much longer compression length 116 for bottom hole assembly 120 utilizing standard steel drill collars shown in FIG. 5C. Standard bottom hole assembly 120 provides only 10.0 thousand pounds and still has a much longer compression length. Bottom hole assembly 120 is much more subject to bending/buckling problems and many other problems as discussed above. As shown in FIG. 5B, compression length 111 is much shorter than compression length 116 but provides a weight on the bit (WOB) of 32.3 thousand pounds or more than three times the WOB as the prior art standard configuration shown in FIG. 5C. Accordingly, it will be anticipated that the configuration of FIG. 5B will drill faster and truer than the prior art configuration of FIG. 5C.

As discussed above, a shortened compression length for the down hole drilling assembly has many advantages, e.g., reduced buckling for truer drilling. It will be noted that above each compression length is a respective neutral zone 122, 124, 126. Above each neutral zone 122, 124, and 126, the drill string is in tension and therefore not subject to buckling. By utilizing the drilling assembly of the present invention, a much larger percentage of the bottom hole assembly is in tension to thereby provide a stiffer bottom hole assembly that will drill a truer gage hole at higher ROP as explained hereinbefore.

Figures 6A, 6B:
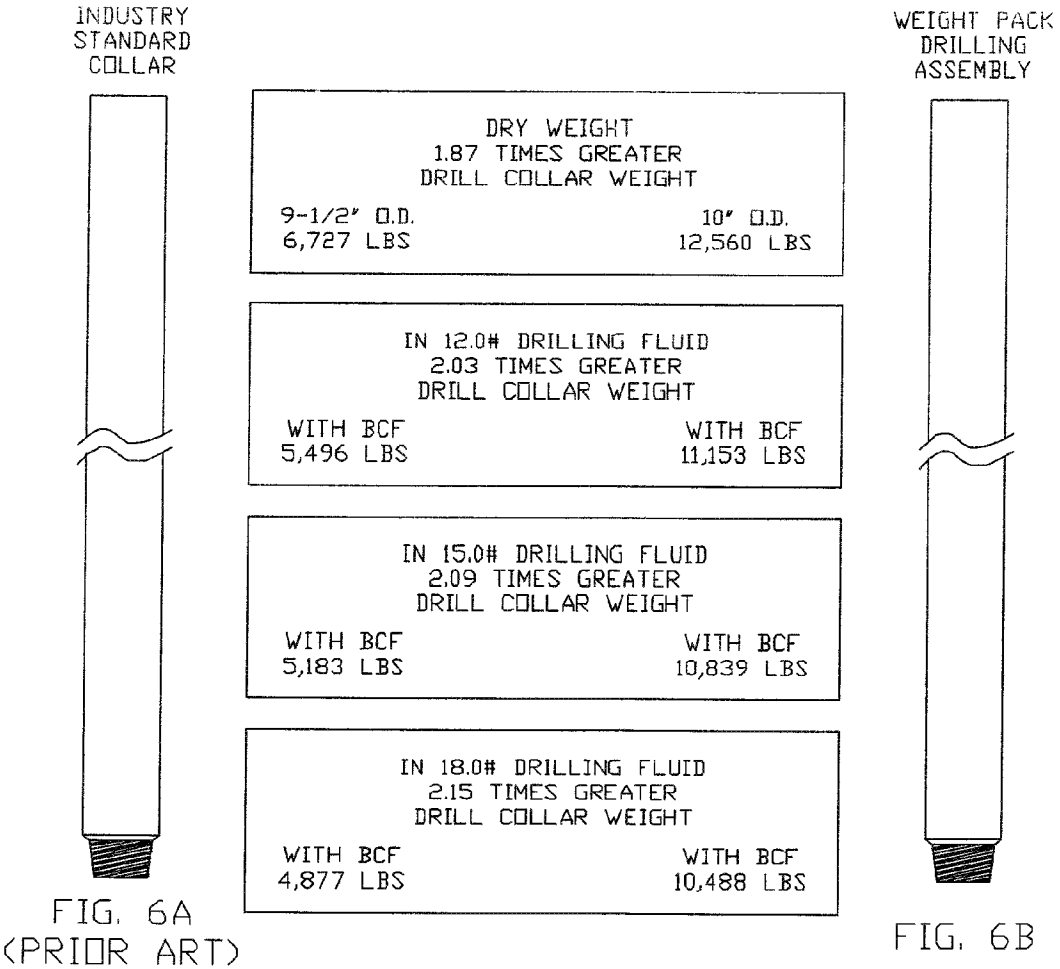
FIG. 6A (PRIOR ART)
FIG. 6A and FIG. 6B are elevational views including a comparison chart showing the effect of buoyant forces of different weight mud for a prior art heavy weight steel drill collar as compared to a high density heavy weight drill collar in accord with the present invention.

FIG. 6B shows one preferred embodiment wherein the diameter of a high density drilling assembly of the present invention may preferably be somewhat enlarged as compared to a standard diameter drill collar. Even though the diameter is enlarged as compared to a standard diameter drill collar, the washout produced by the present invention due to the velocity of fluid through the smaller annulus can be reduced as can be mathematically shown as per the attached equation listings. This is because the length of the heavy weight drill collars can be reduced while still providing the same weight. This analysis ignores the significant effects of faster ROP in reducing washout. Also, this analysis ignores the significant effect of a truer, straighter hole on washouts, which effect is very important. Thus, the same weight of the bottom hole assembly can be provided in a bottom hole assembly that is much shorter, by about one-half. Due to this shortened length, less washout occurs than with a standard steel bottom hole assembly. Prior art larger diameter bottom hole assemblies as discussed in the prior art section had significant problems with washout although the use of wider diameter bottom hole assemblies had the beneficial effects of placing at least some weight closer to the drill bit. Moreover, because the actual weight on the bit may be about several times as much by utilizing the present invention, the rate of penetration may be much faster drilling thereby further reducing borehole washout. The total circulating system pressure drop is also lowered because of the shorter bottom hole assembly. The shorter length of the bottom hole assembly also decreases the likelihood of sticking in the borehole such as differential sticking or other types of sticking making the drilling operation more trouble free of drastic events that may cause loss of the hole.

FIG. 7A is a comparison chart showing the bottom hole assembly compression lengths of two feet versus eighty-nine feet for one embodiment of the present invention as compared to standard drill collars which places the same weight on the drill bit (WOB). FIG. 7B is a comparison chart showing the bottom hole assembly compression lengths and relationship to the first order of buckling for one embodiment of the present invention as compared to standard drill collars which places the same weight on the drill bit. The first order of buckling is approximately 150 feet for a standard 9.5 inch steel drill collar assembly in 12 lb. mud. The second order of buckling is 290 feet. This compares to a first order of buckling for a 10-inch assembly in 12 lb. mud for the present invention of 140 feet and a second order of buckling of 275 feet. In the present invention, the drilling string is in tension at the position of the first and second order of buckling thereby reducing or eliminating buckling. The formulas for these calculations are as follows:

$$1.94\sqrt[3]{(E*144*I*P^2)}\div P=\text{First Order of Buckling}$$

$$3.75\sqrt[3]{(E*144*I*P^2)}\div P=\text{Second Order of Buckling}$$

where:

E=moment of Elasticity

I=moment of Inertia, and

P=Lbs-ft buoyed weight

In the situation of FIG. 7A for 15,750 lbs. weight on the bit (WOB) in 12.0 lb. mud, a bottom hole assembly in accord with the present invention has a compression length that is, for all practical purposes, completely unaffected by buckling.

In the situation of FIG. 7B for 32,390 lbs. WOB in 12.0 lb. mud, a bottom hole assembly in accord with the present invention has a compression length one-tenth of the first order of buckling and so is almost unaffected. However, with a standard drilling assembly, the compression length is greater than the first order of buckling and so the bottom hole assembly is likely to produce substantial wobbling or an unbalanced flywheel effect during rotation.

In the situation of FIG. 7C for 51,500 lbs. WOB in 12.0 lb. mud, a bottom hole assembly in accord with the present invention has a compression length of only about one-quarter of the first order of buckling. To obtain the same WOB with a standard drilling assembly requires a compression length of 290 feet wherein the bottom hole assembly is subject to both first and second order of buckling and is likely to produce substantial wobbling during drilling.

A review of the above description shows that the present invention may be utilized to either greatly increase the stiffness of the bottom hole assembly or greatly increase the flexibility thereof, depending on the desired function.

Figure 8:
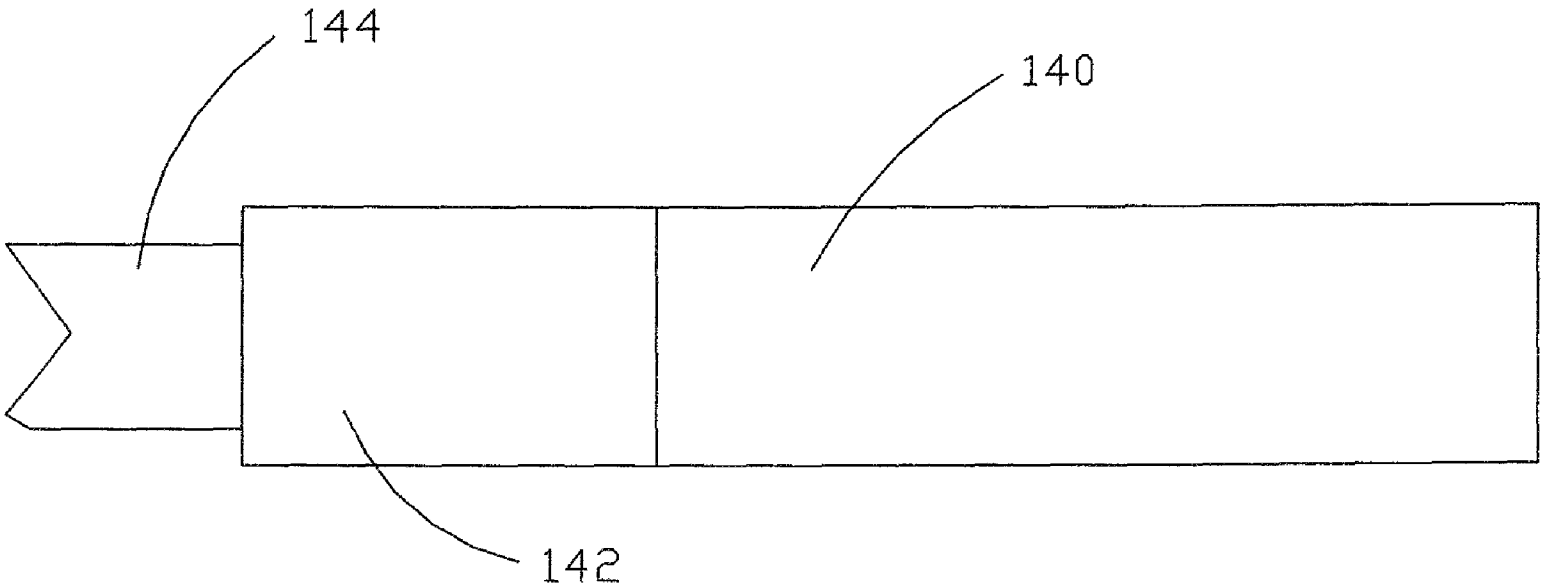
FIG. 8 is a schematical elevational view of one possible use of the present invention as a transition member between the drill pipe and the bottom hole assembly to provide improved drilling operation.

FIG. 8 shows another use of the present invention as a transition element 142 that may be utilized to interconnect bottom hole assembly 140 to the drill pipe string 144. Due to the significant vibration dampening effect of tungsten, the vibrations produced during drilling in the bottom hole assembly can be dampened significantly. This protects the pipe connections and also permits a better signal to noise ratio for acoustic signals transmitted through the drill string or mud for MWD and LWD equipment. The weight packs are still useful for adding weight to and/or shortening the length of bottom hole assembly 140, as discussed hereinbefore. The transition member can be utilized in other locations in the drill string or in multiple positions, if desired.

Figure 9:
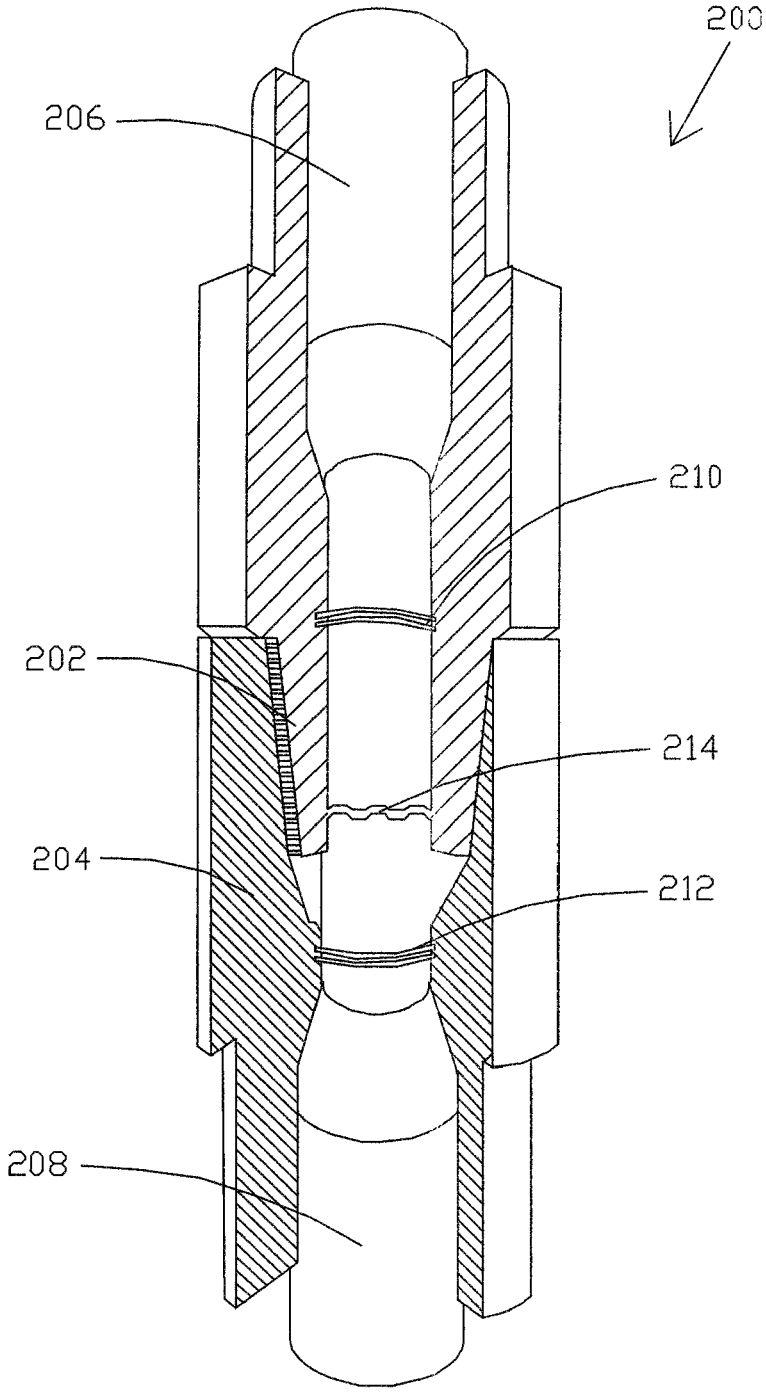
FIG. 9 is an elevational view, partially in cross-section, of a force transfer threadable connection in accord with the present invention.

Force transfer section 200 shown in FIG. 9 provides an enlarged view of a presently preferred embodiment for transferring force, such as weight through threaded pin connection 202 and threaded box connection 204. It is well known that a drilling rig may be utilized for making up and breaking out connections such as 202 and 204 for use in a drilling string. Force transfer section 200 comprises axially moveable upper force transfer tube 206 and lower force transfer tube 208 which may be utilized to transfer force through the threaded connections, such as weight to be applied to the drill bit, as explained heretofore in some detail. Mud seals 210 and 212 may be utilized to seal around the respective upper and lower force transfer tubes. If desire, any suitable anti-rotation connection, such as anti-rotation connection 214 as illustrated, may be provided so that upper force transfer tube 206 and lower force transfer tube 208 do not rotate with respect to each other. It will be noted that upper transfer tube 206 extends axially within pin connection 202 and lower transfer tube 208 extends axially within box connection 204 for transferring force through the connection. It will also be readily apparent that pin connection 202 and box connection 204 can be made up or broken out utilizing standard drilling rig equipment without need for modification thereto. As used herein a drilling rig may include derricks and the like utilized for making up and breaking out tubulars such as workover rigs, completion units, subsea intervention units, and/or coiled tubing units utilized and/or other units for providing long tubulars in wells.

As discussed hereinbefore, another aspect of the present invention is a statically and dynamically balanced drilling assembly. The tolerances on the relatively small components are quite tight and preferably require that the components, such as weight packs and outer tubular be machined round within 0.005 inches and may be less than 0.003 inches. In this way, the rotation axis coincides with one of the principal axis of inertia of the body. The condition of unbalance of a rotating body may be classified as static or dynamic unbalance. For instance, the assembly may be tested to verify that it does not rotate to a "heavy side" when free to turn. Thus, the center of gravity is on the axis of rotation. An idler roll may be in perfect static balance and not be in a balanced state when rotating at high speeds. A dynamic unbalance may occur when the body is in static balance and is effectively a twisting force in two separate planes, 180 degrees opposite each other. Because these forces are in separate planes, they cause a rocking motion from end to end. In the prior art, due to the buckling and bending of the downhole assembly, there is little motivation to attempt to provide a balanced bottom hole assembly because the buckling and bending will cause significant imbalance regardless. For dynamic balancing, the drilling assembly is first statically balanced. After rotating to the operating speed, if necessary, any dynamic unbalance out of tolerance is eliminated by adding or subtracting weight as indicated by a balancing machine. The determination of the magnitude and angular position of the unbalance is the task of the balancing machine and its operator. As discussed hereinbefore, any imbalance out of tolerance can be corrected because the weight pack is provided in sections, any one of which can be rotatably adjusted as necessary and axially positioned. If desired, grooves, pins, or the like may be utilized on pin 34 and socket 36 for weight elements 32 such that each weight element can be affixed in a particular rotational position. A permissible imbalance tolerance is determined based on the mass of the downhole assembly and the anticipated rotational speed.

In summary, the present invention provides a much higher average weight per cubic inch for a downhole assembly. For instance a weight/per unit volume or average density of standard steel heavyweight collar may be about 0.283 pounds per cubic inch wherein an average weight per unit volume of a drilling assembly of the present invention is significantly greater and may be about 0.461 pounds per cubic inch. The vibration dampening characteristics of tungsten reduce bit vibrations for smoother drilling. A heavier average weight per unit volume permits use of a shorter compression length of the bottom hole assembly. The concentration of weight closer to the drill bit reduces bit whirl and bit vibration and bit bounce. In a preferred embodiment, the drilling assemblies of the present invention are much more highly balanced than prior art bottom hole assembly elements due to much tighter control of overall tool concentricity and straightness. Increased rate of penetration occur due to reduced bit wear, vibration dampening, reduced bit whirl, and reduced bit bounce. Because of decreased vibration, fewer trips are required because the bit life is lengthened and the tool joints are less subject to vibration stress. Lower torque stress is applied to the drilling string because of less wall contact by the bottom hole assembly due to decreased surface area and more concentric rotation thereof. The compression length of a bottom hole assembly in accord with the present invention is much reduced as compared to the first or second order of tubular buckling (see attached calculation sheets) so that the bottom hole assembly in accord with the present invention is straighter. It should also be noted that a more highly balanced, vibration dampened, bottom hole assembly built utilizing weighting assemblies such as drilling assembly 10, 12, 14, 30, or 50, or variations thereof can be rotated faster with less vibration and harmonics to thereby increase drilling rates of penetration.

The weight transfer assembly is operable to transfer the inner weight of several drill collars through the tool joints from the upper collar to a lower or lowest point in the drill string while keeping the entire BHA (bottom hole assembly) in tension. There are no bending or buckling moments in the string and all of the weight may be placed directly above the bit. The collars may be the same length as standard drill collars and there is no difference in make-up or break-out. The near bit assembly may have a tungsten matrix weight while the assemblies above may have tungsten/lead weights. The tungsten matrix reduces vibration, bounce, and chatter and provides more power in a compact area directly above the bit. By transferring the weight for drilling to a point very near the drill bit, the neutral point is also lowered to that point. Additionally putting the weight directly above the bit increases the force of restitution (force required to move a pendulum from its vertical position) and increases the centripetal force that cause a body to seek a true concentric axis of rotation. Placing the weight near the bit increases the inertia or impact of the bit against the formation and holds the bit steadier against the formation as may be especially desirable for certain types of drill bits. The resistance to drag is also increased due to the greater inertia resulting in a more stable drilling speed of the bit.

The present invention provides a means for producing a stiffer drilling assembly that has many benefits, some of which are discussed above, by applying a force to force transfer tubes. The force may be produced by weights or by other means. As noted above, bronze expansion tabs shown in FIGS. 4C and 4D, may utilize a downhole thermal expansion differential with respect to steel to produce a force or tension on the force transfer tubes. Many other possible means may also be utilized to produce a force or tension on the force transfer tubes. Some possible examples are discussed hereinafter.

Figure 10:
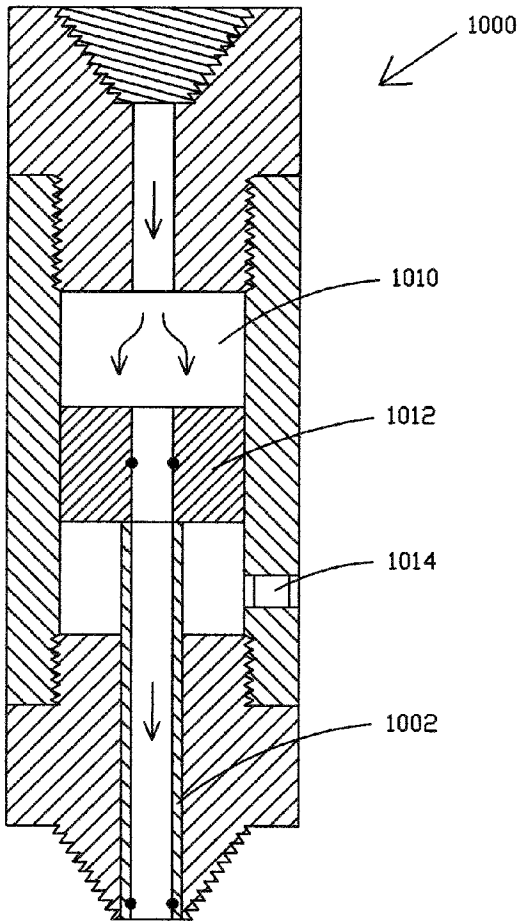
FIG. 10 is an elevational view, in cross-section, of a hydraulic tension inducing sub to produce a downward force on force transfer tubes in accord with one possible embodiment of the present invention.
Figure 12:
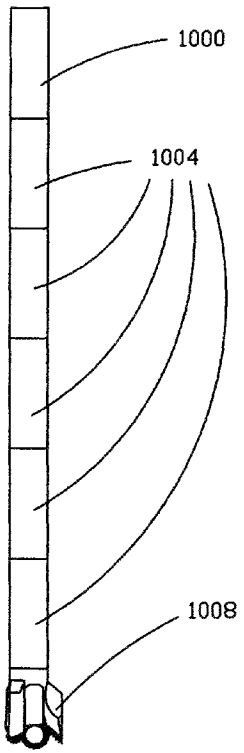
FIG. 12 is an elevational view of a bottom hole drilling assembly utilizing a tension inducing sub and modified drill collars that include force transfer tubes in accord with one possible embodiment of the present invention.
Figure 11:
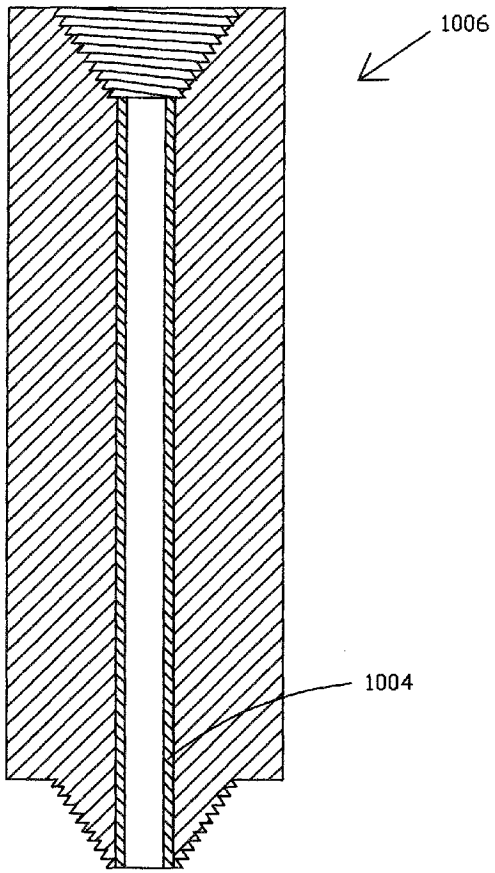
FIG. 11 is an elevational view, in cross-section, of a standard drill collar which has been modified slightly to accept a force transfer tube in accord with one possible embodiment of the present invention.

FIG. 10 shows a hydraulic tension inducing sub 1000, which produces a force on force transfer tube 1002 in accord with one possible embodiment of the present invention. Tension inducing sub 1000 may use differential pressure to produce a force. For instance, in one embodiment, the differential hydraulic pressure between the annulus outside tension inducing sub 1000 and the mud column pressure at 1010 is applied to piston 1012. Piston 1012 applies this force to axially moveable force transfer tube 1002, which transfers the force to the string for other force transfer tubes 1004 and eventually to the top of bit 1008, as indicated in FIG. 11 and FIG. 12. If desired, pressure equalizing piston 1014 may be utilized to pressurize hydraulic fluid beneath piston 1012 to the same pressure as that in the annulus.

In another embodiment, FIG. 11 shows a standard drill collar 1006 which has been modified to accept a force transfer tube 1004 in accord with one possible embodiment of the present invention. In one embodiment, force transfer tube 1004 may be mounted to move or float axially by a certain fixed amount within standard drill collar 1006. For instance, as one possible means for doing this, within an existing drill collar 1006, the weight section might be bored out to accept force transfer tube 1004. Drill collars 1006 could also be originally made with force transfer tube 1004. Although many constructions may be utilized, in one possible embodiment, force transfer tube may comprise a collar, enlargement, or the like of desired width at the upper end to act as a stop surface (not shown). A counterbore within drill collar 1006 would permit movement of the stop surface within the counterbore by a certain axially length. After insertion of force transfer tube 1004 into drill collar 1006, a nut or the like which blocks further axial movement of force transfer tube 1004 may be inserted to one end of the counterbore, so that the desired limited amount of axial movement is allowed. Other means for accomplishing the same mechanical result could also be used. Smaller force transfer tubes that fit in the original openings might also be used. Accordingly, there are many ways, typically low cost, for modifying standard drill collars to incorporate force transfer tubes. As noted hereinbefore, force transfer tubes can be made in many different ways to effect force transfer from one section to another.

FIG. 12 is an elevational view of a bottom hole drilling assembly utilizing a tension inducing sub, such as tension inducing sub 1000 or other versions thereof, some of which are discussed herein, along with weight sections that may comprise modified drill collars 1006 or other tubular members that comprise force transfer tubes 1004 in accord with one possible embodiment of the present invention.

In operation, an embodiment of the invention such as shown in FIGS. 10-12, provides that a force is created on force transfer tubes 1004 by tension inducing sub 1000, or other tension inducing means such as that shown in FIGS. 4C and 4D or other tension inducing means. The force so produced on the force transfer tubes 1004 is provided to be sufficiently greater than combined weight of drill collars 1006. Therefore, the external bodies of drill collars 1006 are held in tension even though in a typical BHA during drilling they would be at least partially in compression, as per the discussion hereinbefore.

In the example of FIG. 10, a tension inducing sub 1000 produces a downward force acting on force transfer tube 1002 and all subsequent force transfer tubes 1004 which might be, for example only, a downward force of 60,000 pounds, depending on the hydraulics. If the drill collars 1004 shown in FIG. 12 collectively weigh 30,000 pounds, then the entire threadedly connected drill collar string formed by drill collars 1006 will be in tension at a force of 30,000 pounds rather than in compression. An additional benefit is that, for reasons discussed hereinbefore, the collective weight of 30,000 pounds of the string of drill collars 1006 is applied to the top of drill bit 1008 through the force transfer tubes. Moreover, the stiffer drilling assembly would have numerous benefits and could be made very inexpensively.

Subsequent figures show various other embodiments of tension inducing subs also in accord with the present invention. However, the invention is not limited by the particular embodiments of the invention shown herein, which may be selected based on the particular requirements. Once the concept of the present invention is understood by those of skill in the art, it will be understood that the tension inducing sub of the present invention may be implemented I many various types of devices that may be used to apply a desired amount of force on the force transfer tubes including, but not limited to, pressurized nitrogen acting on a piston, gases produced by relatively slow burning explosives, springs, temperature expansion, and the like. Moreover, multiple downhole tension inducing subs may be stacked together to thereby multiply the force created thereby which acts on the force transfer tubes. The operation might also be controlled with downhole sensors depending on the type of tension inducing sub construction. For instance, tension inducing sub 1000 might utilize downhole valving and feedback control sensors to maintain a desired tension due to variations in the downhole hydraulics.

Figure 13:
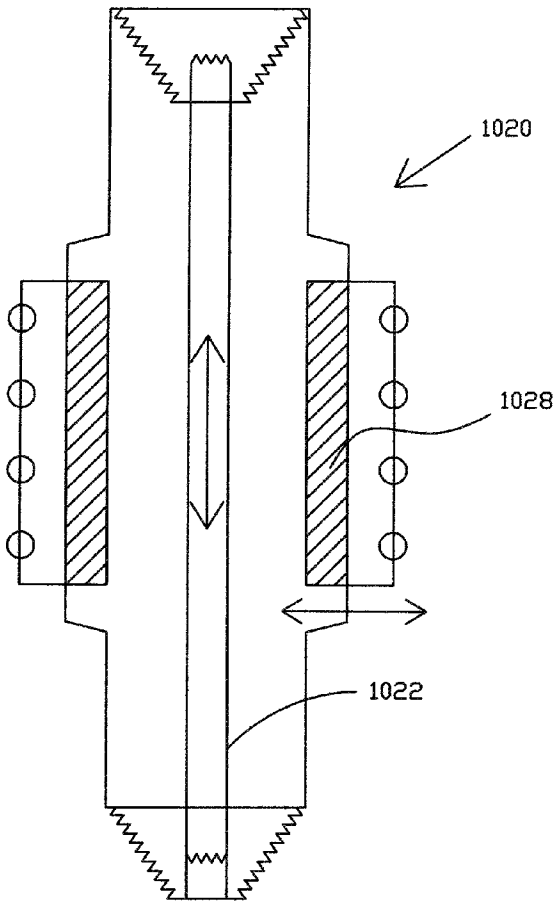
FIG. 13 is an elevational sketch showing a reamer that has been modified to utilize a force transfer tube in accord with one possible embodiment of the present invention.
Figure 14:
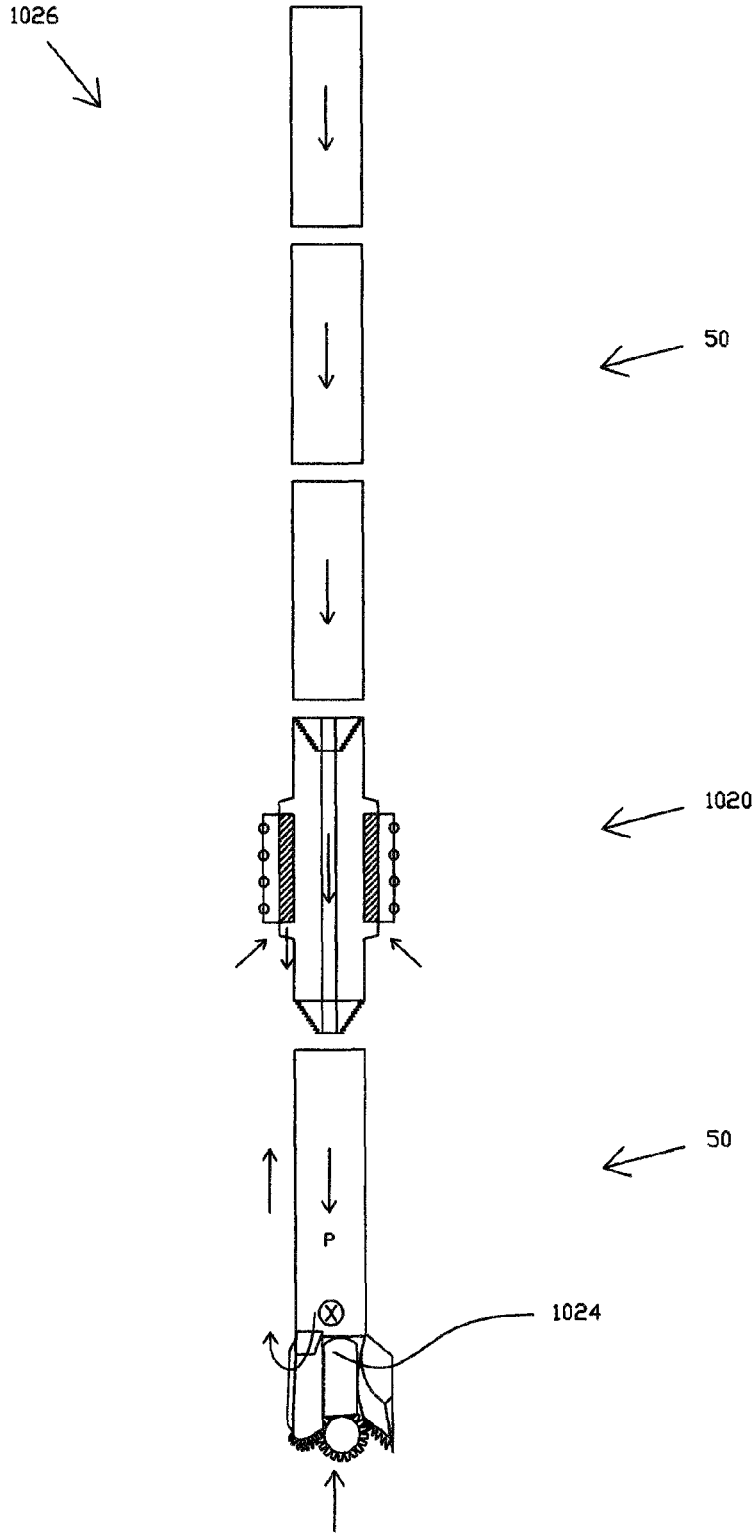
FIG. 14 is an exploded elevational sketch showing a reamer modified to accept a force transfer tube utilized in a downhole assembly along with Heavi-Pac™ weight sections in accord with one possible embodiment of the present invention.

It will be understood that various downhole tools may utilize force transfer tubes 1004 for stiffening their construction utilizing the principles disclosed herein. For instance, a reamer is subject to bending forces wherein in a stiffer reamer may operate with greatly improved performance. As one example of a stiffer reamer assembly, FIG. 13 is an elevational sketch showing reamer 1020 that has been modified to utilize an axially moveable force transfer tube 1022 in accord with one possible embodiment of the present invention. Reamer blades 1028 may move radially outwardly as indicated for reaming out a section of the borehole to, for example, facilitate a gravel pack operation or for other purposes. FIG. 14 is an exploded elevational sketch of downhole assembly 1026 showing reamer 1020 as may be utilized along with weight sections, such as weight sections 50 (see also FIG. 3A or 3B) or other weight sections, preferably utilizing force transfer tubes, or tension inducing subs such as sub 1000. Additional weight sections 50 may be connected below reamer 1020 which may also connect to bit 1024. In operation, downhole assembly 1026 places reamer 1020 in tension rather than compression, which is believed to improve functioning of reamer 1020 which may otherwise be subject to bending as may affect the reaming performance.

Figure 15:
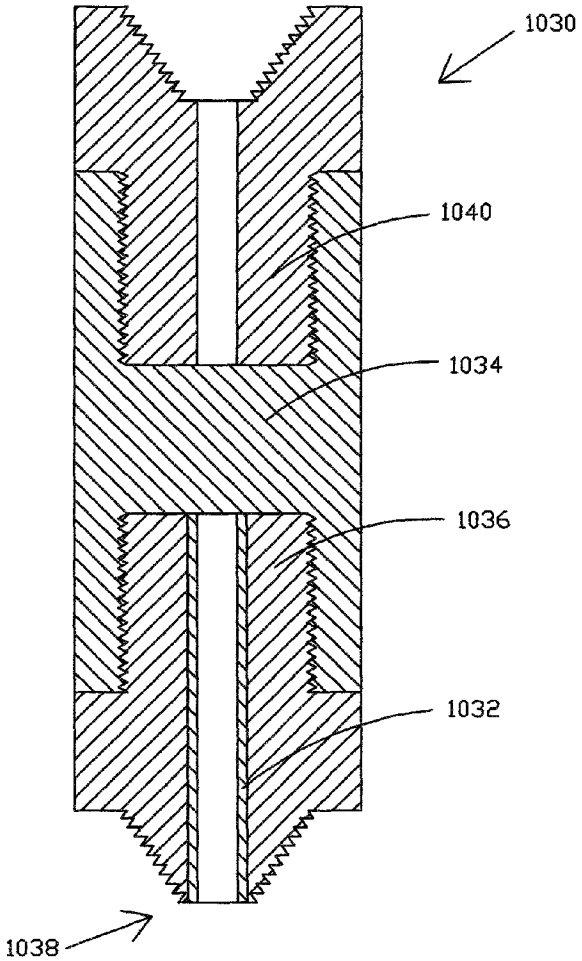
FIG. 15 is an elevational sketch, in cross-section, of a rig-tightened tension inducing sub utilized to apply a force to a force transfer tube in accord with one possible embodiment of the present invention.

FIG. 15 is an elevational sketch, in cross-section, of yet another tension inducing sub 1000. In this embodiment, tension inducing sub 1000 may be rig-tightened utilizing a drilling rig to provide a desired rotational force. After tightening, tension inducing sub 1030 then applies force to a force transfer tube 1032 in accord with one possible embodiment of the present invention. In this embodiment, force transfer tube 1032 may be selected to be a specific length which will result in a desired amount of tension produced in the weight sections. Section 1036 may be connected to a bottom hole assembly with force transfer tubes, e.g., three weight sections 50 comprising force transfer tubes, or modified standard collars 1006. Once threaded section 1036 is tightened by the rig or the like to the uppermost weight section, then a desired length force transfer tube 1032 may be inserted into section 1036. Then section 1034 is tightened by the rig. The length of force transfer tube is selected to place the known length of weight sections 50 into a desired tension. For instance, as an example which is intended only to show operation, suppose it is desired to produce 50,000 pounds of tension in the three weight sections 50. Suppose also that 0.125 inches of extension 1038 of force transfer tube 1032 produces 50,000 pounds tension in a length of three weight sections. Then the length of force transfer tube 1032 may be chosen to effect this amount of tension. It will be appreciated that if there were six weight sections, with identical stretch as described above, then 0.25 inches of extension 1038 would be required to place all six sections in 50,000 pounds of tension. As a non-limiting example, a typical preload amount may range from 10,000 to 150,000 pounds of tension in such a string and 50,000 pounds may sometimes be considered in the general range of optimal. However, this depends on hole conditions, on the type of weight sections, and the type of bit. It will be appreciated that once 1034 is tightened to produce the desired tension, then upper section 1040 may be attached and the upper drill string is then attached in a typical way.

FIG. 16-FIG. 24B show another possible embodiment of an adjustable force tension inducing sub in accord with the present invention. In this embodiment, the basic operation is the same as discussed above. Instead of utilizing hydraulic power, or rig torsion, or nitrogen pressure, or thermal expansion tabs, or the like, the tool provides an adjustable length tube. It will be appreciated that many different assemblies and/or methods may be utilized to produce a variable length force transfer tube or applying a variable force to force transfer tubes.

Figure 16:
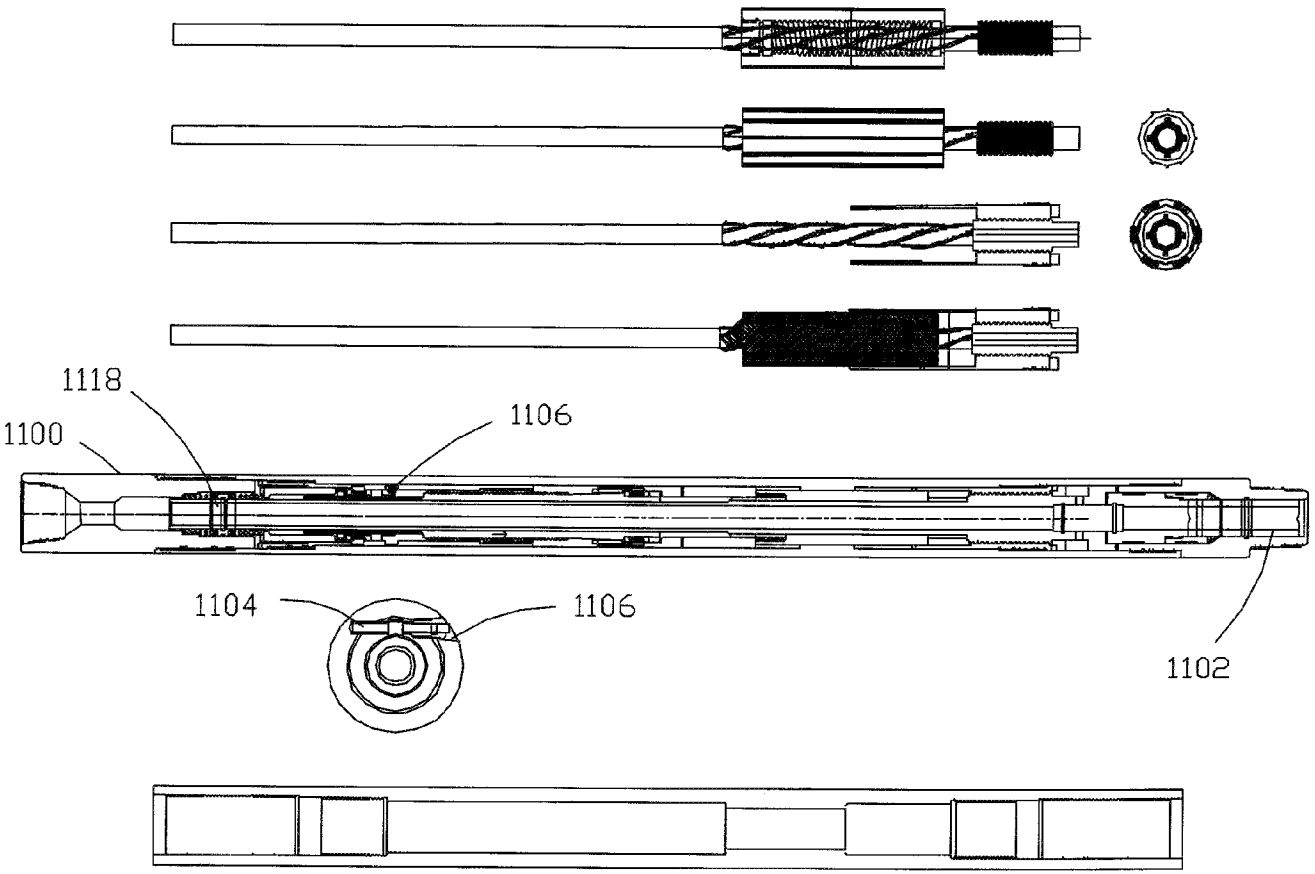
FIG. 16 is a view of components utilized in an adjustable force tension inducing sub in accord with one possible embodiment of the present invention.

Referring to FIG. 16, tension inducing sub 1100 is shown in cross-section. Tension inducing sub 1100 permits an operator to dial in a desired amount of force onto force transfer tube 1102 which can be used to place a downhole string of weight sections having force transfer tubes into a selectable amount of tension. In this embodiment, worm gear 1104 is accessible from opening 1106 to accomplish this. The internal components provide a high mechanical advantage so that a small force on worm gear 1104 over a predetermined number of turns results in a large force on transfer tube 1102. For instance, as one possible example, 300 turns at 2.3 foot pounds on worm gear 1104 may produce 50,000 pounds of force on force transfer tube 1106. In one embodiment, a drill or the like, perhaps with a counter, may be utilized to drive worm gear 1104 over the 300 or other number of desired turns. Other views shown in FIG. 16 are presented for convenience and also shown in the remaining figures. In operation, tension inducing sub 1100 is connected to the top of a bottom hole assembly. As discussed above, the amount of tension which will be induced by movement of force transfer tube 1102 is known and related to the number of weight sections. As also discussed above for one possible example only to show operation, force transfer tube 1102 might be moved by 0.125 inches to apply 50,000 pounds of tension to three weight sections already connected together. Alternatively, 50,000 pounds of tension might be applied to six of the same type of weight sections by moving force transfer tube by 0.250 inches. In any event, the amount of movement is known from the stretch characteristics of weight sections and the desired amount of tension is dialed in using worm gear 1106.

Figure 17A:
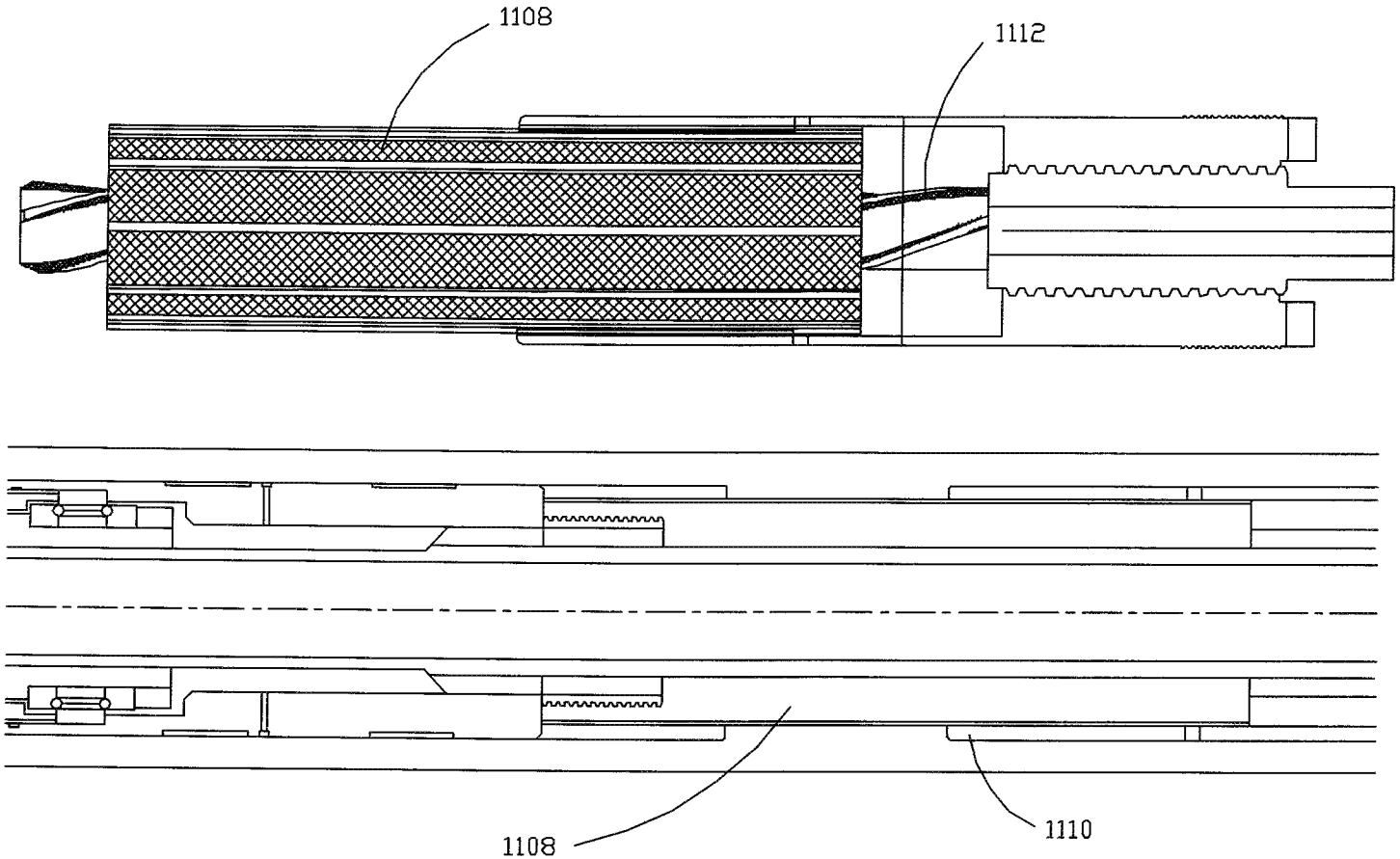
FIGS. 17A and 17B combine to form an elevational view of components of the adjustable force tension inducing sub of FIG. 16 in accord with one possible embodiment of the present invention.
Figure 17B:
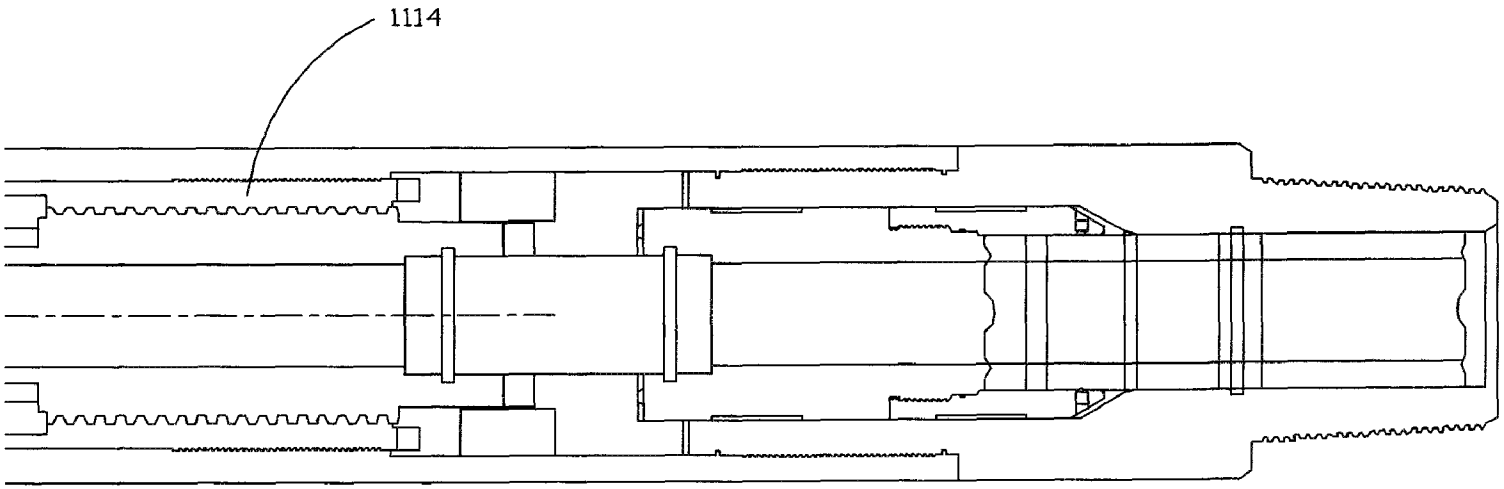
Figure 18A:
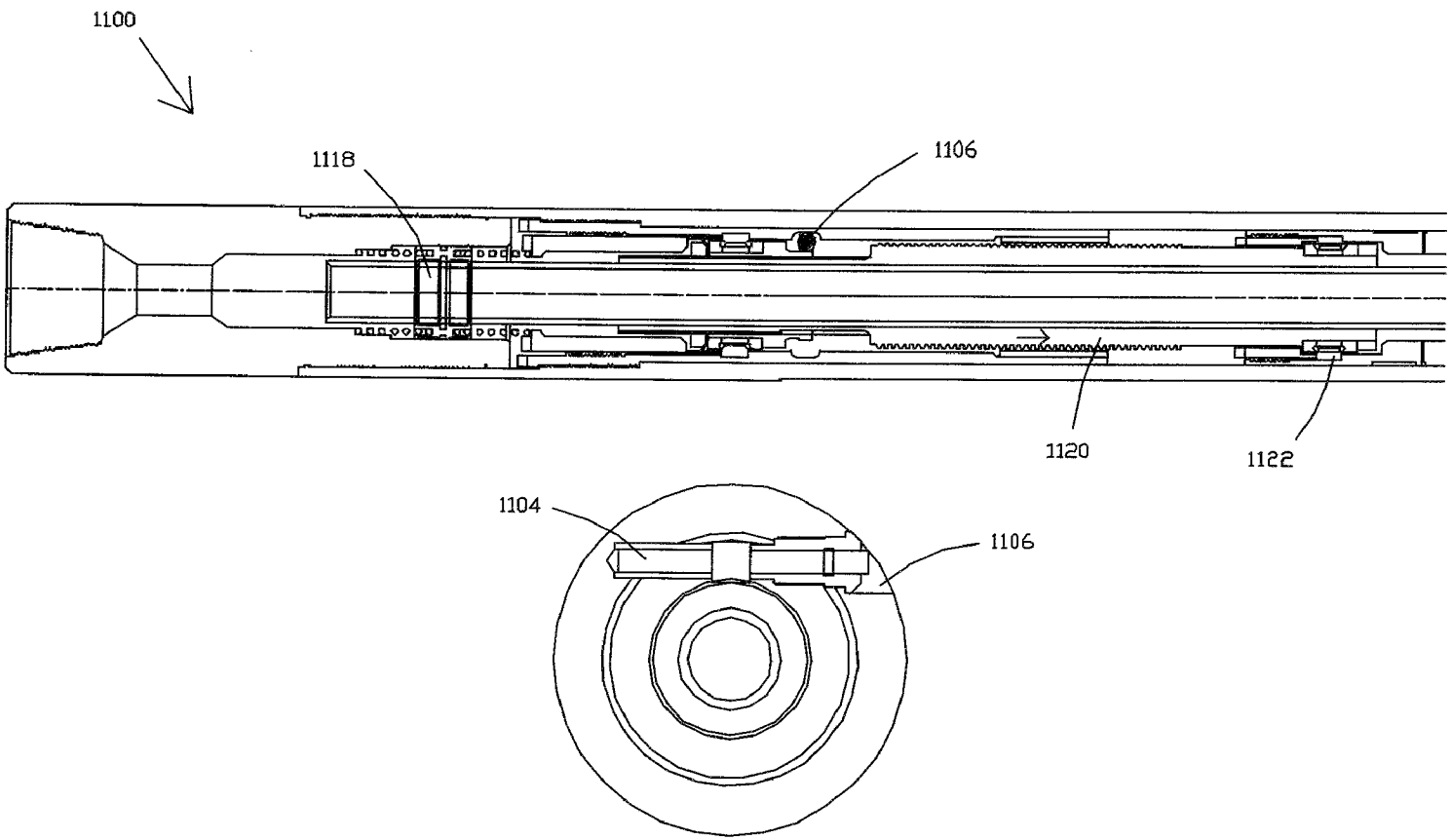
FIGS. 18A and 18B combine to form an elevational view of components of the adjustable force tension inducing sub of FIG. 16 in accord with one possible embodiment of the present invention.
Figure 18B:
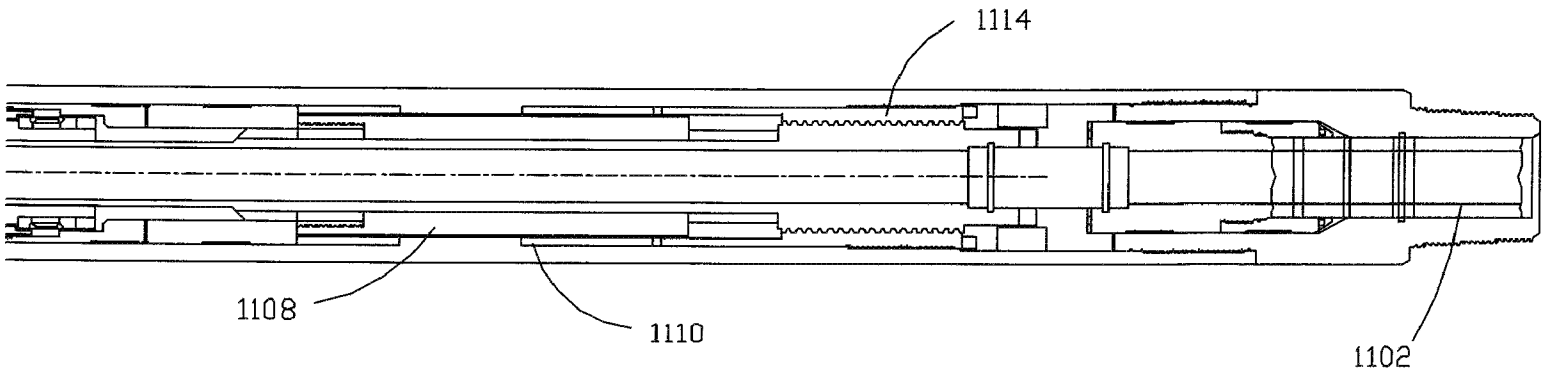
Figure 19:
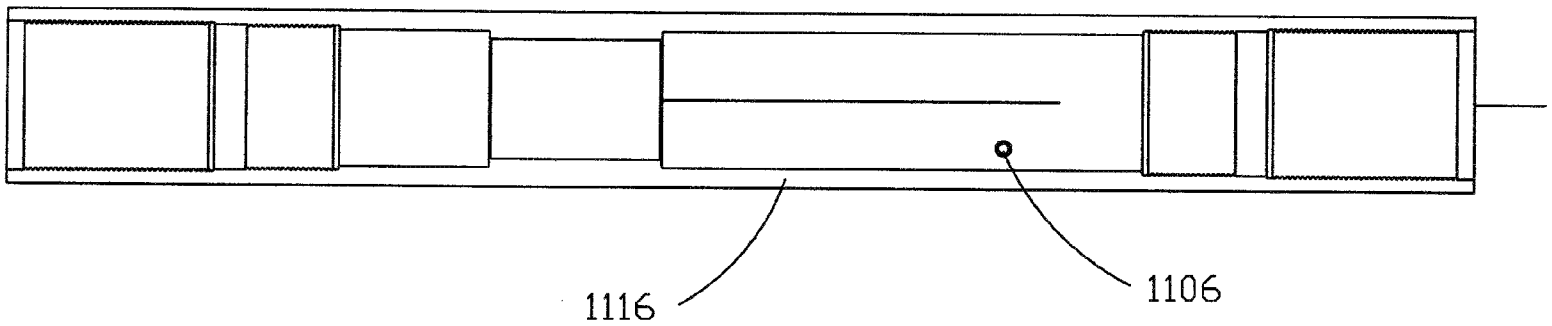
FIG. 19 is an elevational view of components of the adjustable force tension inducing sub of FIG. 16 in accord with one possible embodiment of the present invention.

FIGS. 17A and 17B show rapid transit nut 1108 which is splined to mate to spline housing 1110 to permit axial movement only. In one preferred embodiment rapid transit nut 1108 can move axially by six inches. As rapid transit nut 1108 is moved axially as a result of turning worm gear 1104, spiral screw 1112 rotates thrust screw 1114. In one embodiment, six inches of axial movement of rapid transit nut 1108 produces one-quarter turn of spiral screw 1112 and also thrust screw 1114 which results in 0.250 inches of axial movement of thrust screw 1114, which in turn is applied to transfer tube 1102. FIGS. 18A and 18B show an enlarged view of tension inducing sub 1100 shown in FIG. 16 with components from FIGS. 17 and 17B marked as indicated. FIG. 19 illustrates one possible embodiment of an outer body 1116 for tension inducing sub 1100.

Figure 20:
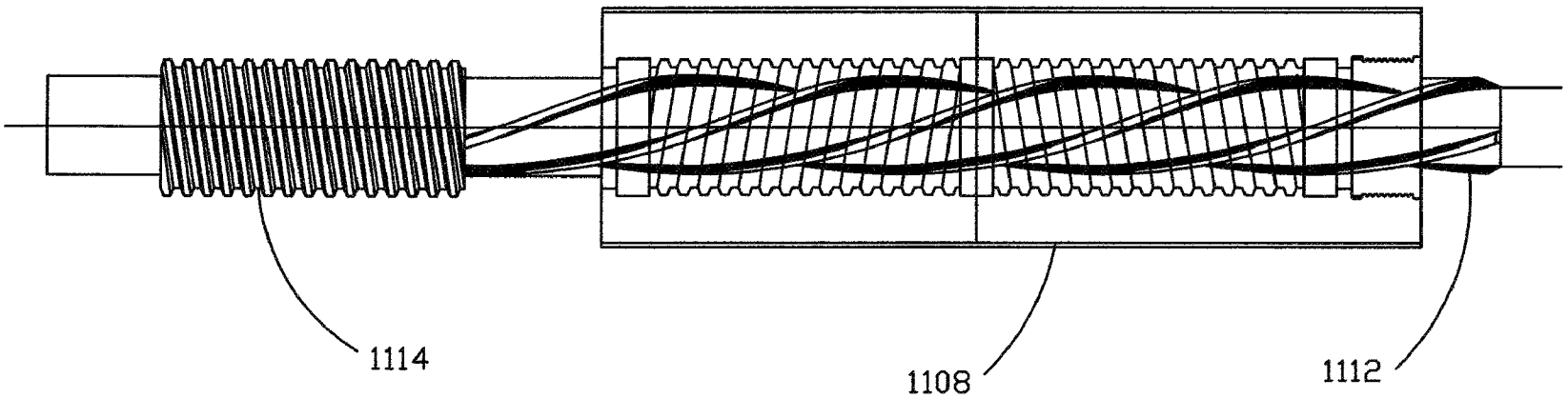
FIG. 20 is an elevational view of components of the adjustable force tension inducing sub of FIG. 16 in accord with one possible embodiment of the present invention.
Figure 21A:
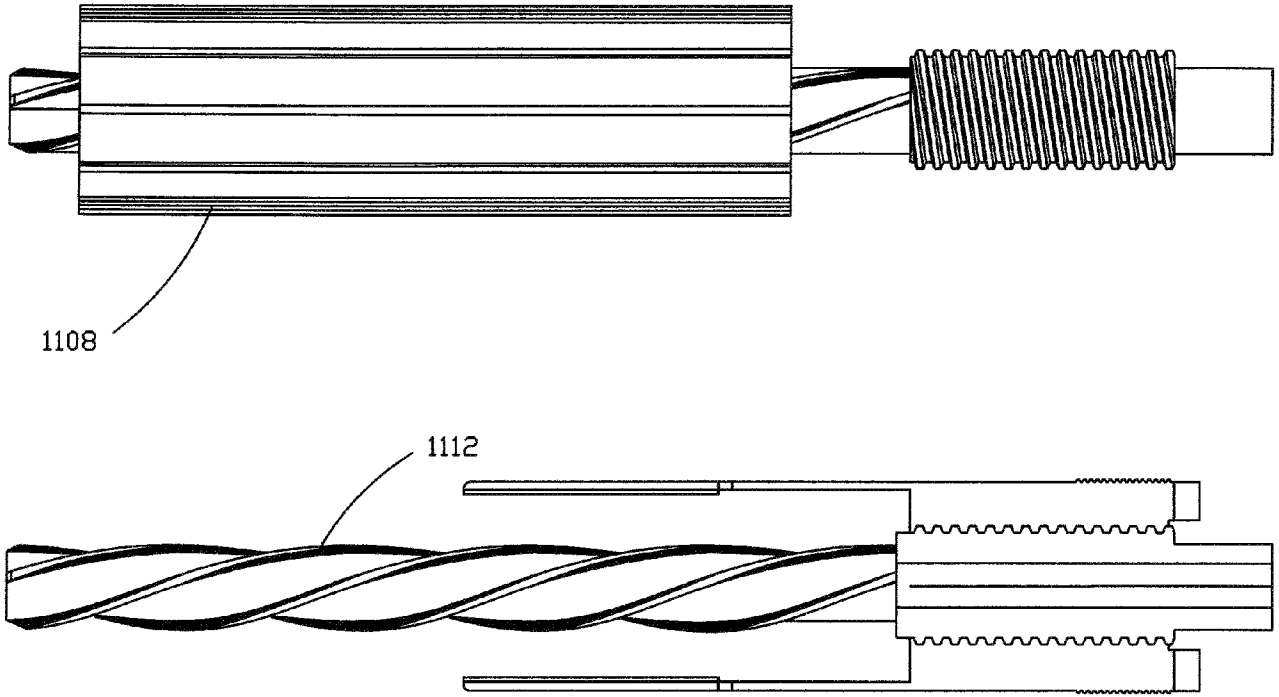
FIGS. 21A and 21B combine to form an elevational view of components of the adjustable force tension inducing sub of FIG. 16 in accord with one possible embodiment of the present invention.
Figure 21B:
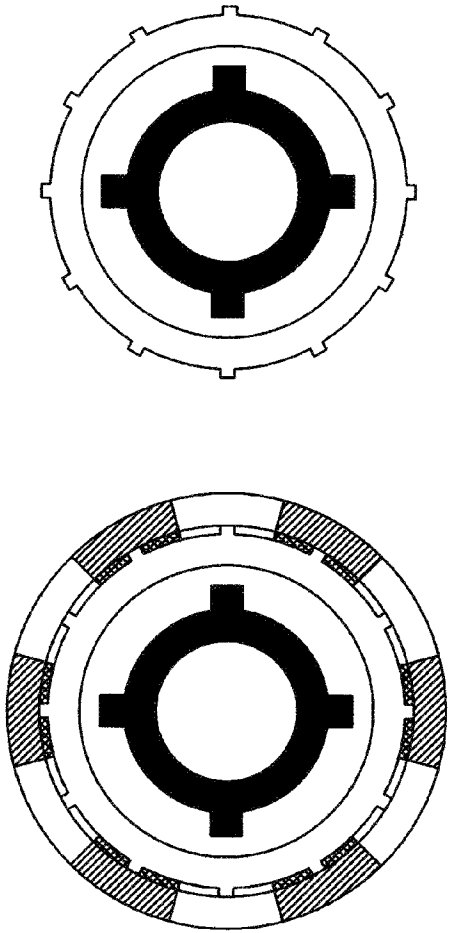
Figure 22A:
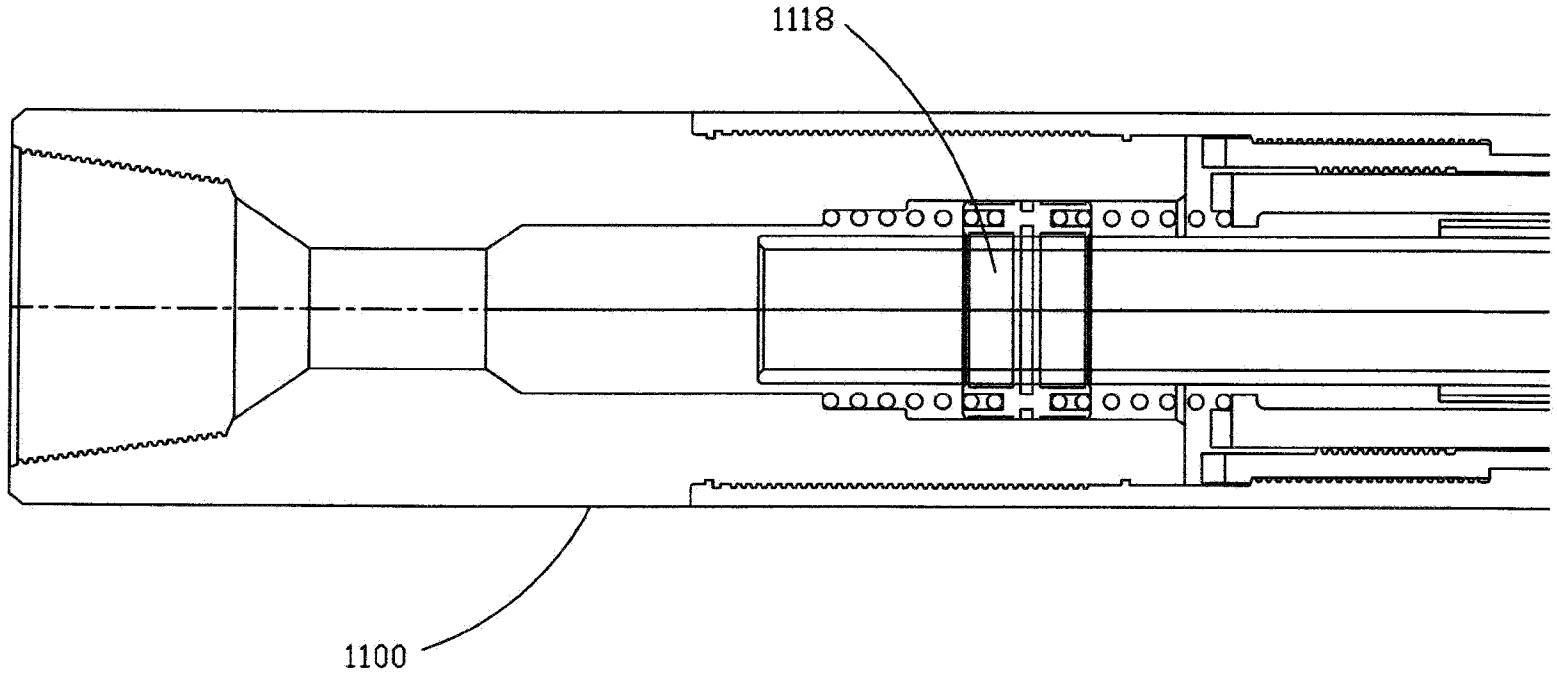
FIGS. 22A and 22B combine to form an elevational view of components of the adjustable force tension inducing sub of FIG. 16 in accord with one possible embodiment of the present invention.
Figure 22B:
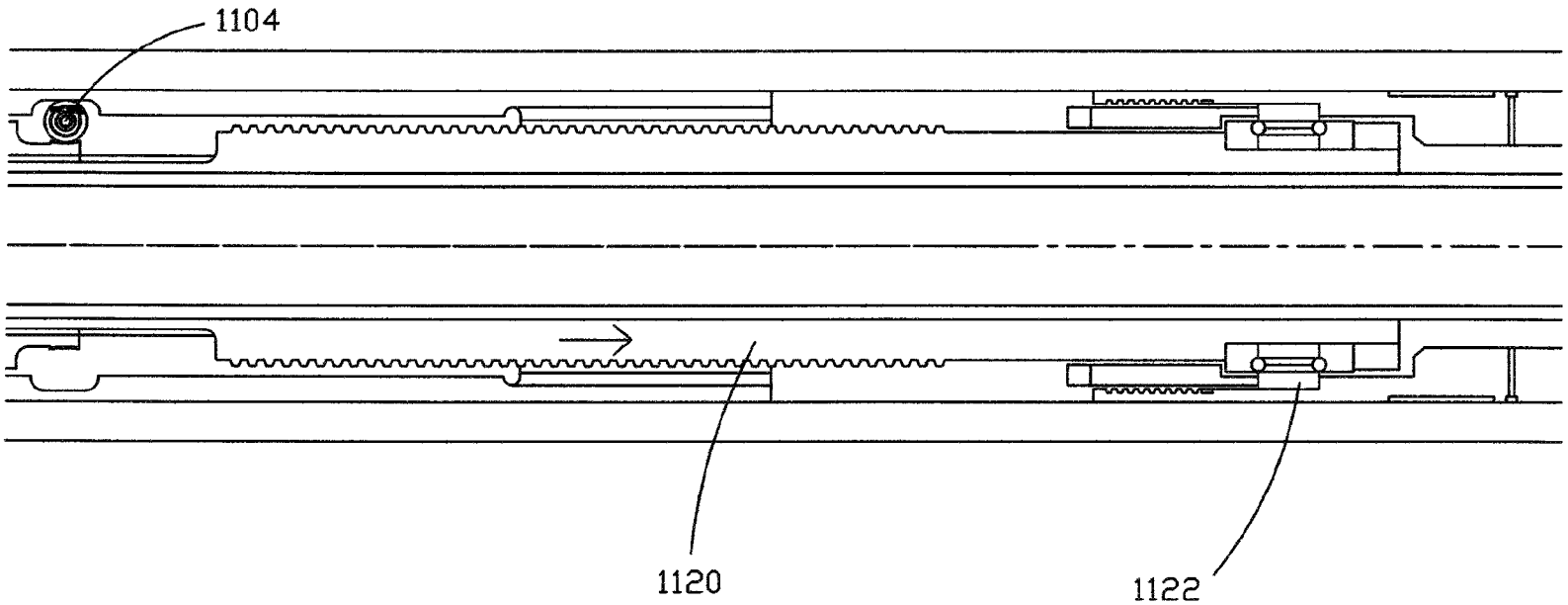
Figure 23A:
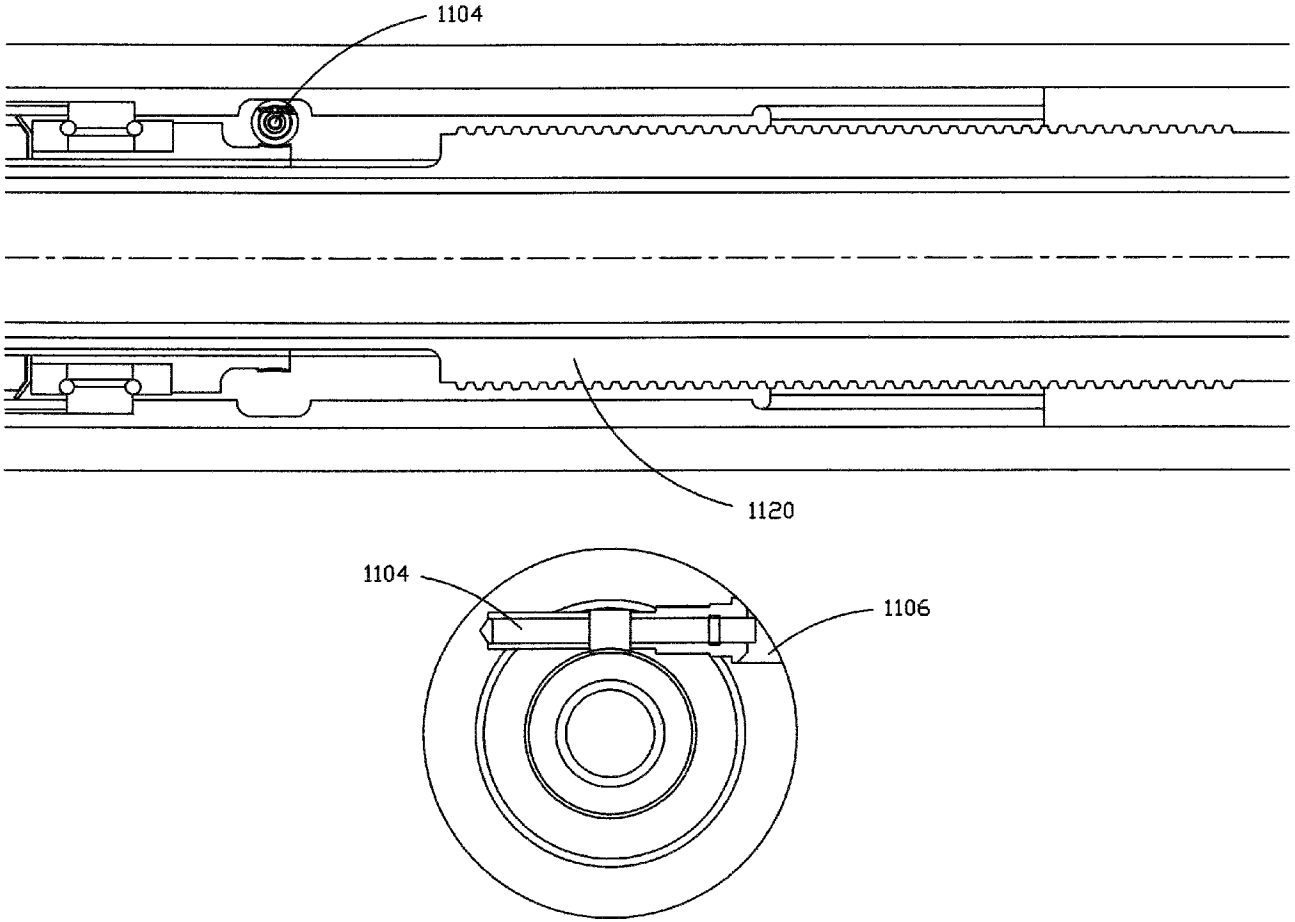
FIGS. 23A and 23B combine to form an elevational view of components of the adjustable force tension inducing sub of FIG. 16 in accord with one possible embodiment of the present invention.
Figure 23B:
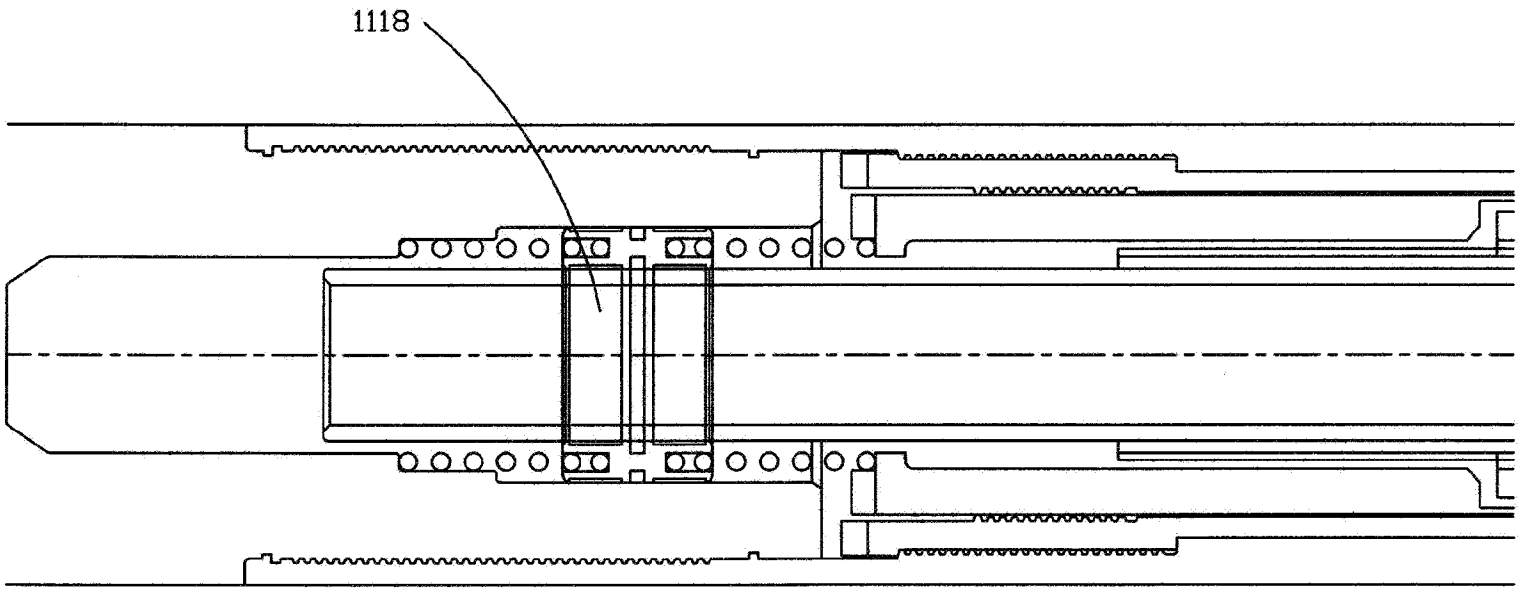

FIG. 20 shows rapid transit nut 1108 and an internal view of spiral screw 1112 within rapid transit nut 1108. Spiral screw 1112 mates to internal threads within rapid transit nut 1108. In one embodiment, rather than machining internal threads within rapid transit nut 1108, bearing material such as babbit is poured into an interior of rapid transit nut 1108 while spiral screw is positioned therein and allowed to cool to thereby provide mating threads. FIGS. 21A and 21B show additional views of rapid transit nut 1108 and spiral screw 1112.

Figure 24A:
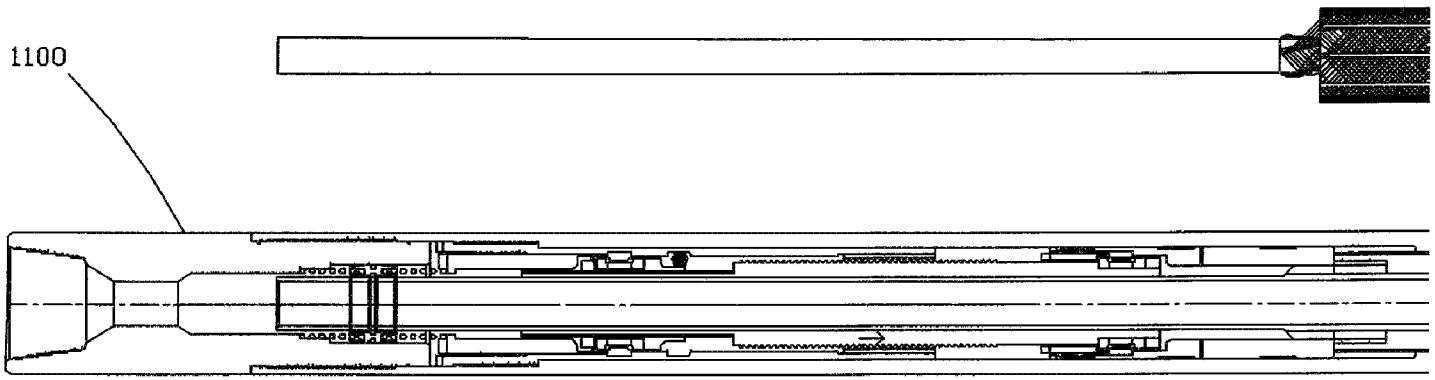
FIGS. 24A and 24B combine to form an elevational view of components of the adjustable force tension inducing sub of FIG. 16 in accord with one possible embodiment of the present invention.
Figure 24B:
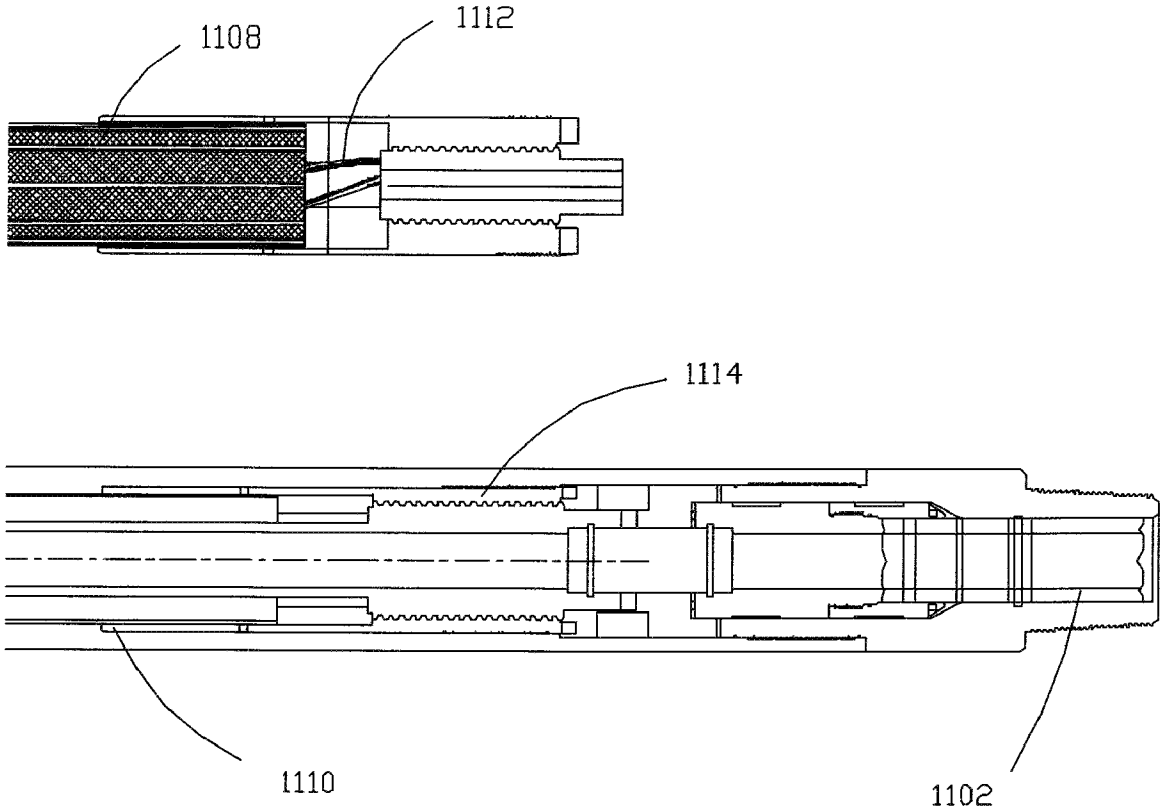

FIGS. 22A, 22B, 23A and 23B show pressure balance piston 1118 to provide for equalizing pressure between the bore and interior components of tension inducing sub 1100. Worm gear 1104 rotates travel nut 1120 which moves axially and engages rapid transit nut 1108 through nut thrust bearing 1122. FIGS. 24A and 24B show a cross-sectional view of tension inducing sub 1100 as compared with rapid transit nut 1108 and spiral screw 1112.

In operation, tension inducing sub 1000 or 1100, or other tension inducing subs or means discussed hereinbefore, may be used to produce a desired tension in attached weight sections which include force transfer tubes. Tension inducing sub produces a force on the force transfer tubes which stretch or place the outer walls of the weight sections in tension. The weight of the entire string may then be applied to the top of the bit while the bottom hole assembly is held in tension.

The foregoing disclosure and description of the invention is therefore illustrative and explanatory of a presently preferred embodiment of the invention and variations thereof, and it will be appreciated by those skilled in the art, that various changes in the design, manufacture, layout, organization, order of operation, means of operation, equipment structures and location, methodology, the use of mechanical equivalents, as well as in the details of the illustrated construction or combinations of features of the various elements may be made without departing from the spirit of the invention. For instance, the present invention may also be effectively utilized in coring, reaming, milling and/or other operations as well as standard drilling. The present invention may be used with relatively inexpensive drill collars modified to include force transfer tubes.

In general, it will be understood that such terms as "up," "down," "vertical," and the like, are made with reference to the drawings and/or the earth and that the devices may not be arranged in such positions at all times depending on variations in operation, transportation, mounting, and the like. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. Thus, various changes and alternatives may be used that are contained within the spirit of the invention. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative of a presently preferred embodiments and not in a limiting sense.

What is claimed is:

1. A method for making a heavy weight section for a bottom hole assembly for drilling a bore hole through an earth formation, said bottom hole drilling assembly being secured to an end of a drill pipe string and being operable for applying drilling weight to a drill bit for drilling said bore hole, said method comprising:

providing a first outer tubular comprising an outer tubular radial wall thickness;

positioning a first top sub on one end of said first outer tubular;

positioning a first bottom sub on an opposite end of said first outer tubular;

providing a high density weight section inside said first outer tubular for supplying at least a portion of said drilling weight to said drill bit, providing that high density weight section comprises a specific gravity greater than 10.0; and providing that said high density weight section comprises a high density radial wall thickness which is at least 25% greater than said outer tubular radial wall thickness.

2. The method of claim 1, further comprising providing that said high density radial wall thickness is at least 50% greater than said outer tubular radial wall thickness.

3. The method of claim 1, further positioning a centralizer between said high density weight section and said first outer tubular to prevent a radial movement of said high density weight section with respect to said first outer tubular.

4. The method of claim 1, further comprising positioning a first inner tubular inside of said high density weight section, said first inner tubular defining a fluid flow path therethrough.

5. The method of claim 4, further comprising providing fluid tight sealing between said first inner tubular and said high density weight section.

6. The method of claim 1, further comprising mounting said high density weight section for limited sliding axial movement of said first high density weight section with respect to said first outer tubular.

7. The method of claim 1, further comprising mounting said high density weight section to prevent axial movement of said first high density weight section with respect to said first outer tubular.

8. The method of claim 1, further comprising: providing a second outer tubular that is securable with respect to said first bottom sub, and providing at least one additional annular high density weight section within said second outer tubular.

9. The method of claim 1, further comprising forming said high density weight section by inserting powdered tungsten or a tungsten slurry into said first outer tubular.

10. A method for making a plurality of heavy weight sections for a bottom hole drilling assembly, said bottom hole drilling assembly being utilized for drilling a bore hole through an earth formation, said bottom hole drilling assembly being secured to a drill pipe string and being operable for applying a drilling weight to a drill bit for drilling said bore hole such that during drilling then a length of said bottom hole drilling assembly is in tension and a length of said bottom hole assembly adjacent to said drill bit is in compression, said plurality of weight sections comprising:

providing a plurality of connections for connecting between said plurality of heavy weight sections:

providing a plurality of slidable members which transfer force through said plurality of connections, whereby when said drilling weight on said drilling bit during drilling is greater than 10,000 pounds then said length of said bottom hole assembly in compression is less than fifty feet.

11. The method of claim 10, further comprising providing at least one high density weight section comprises a specific gravity greater than 10.0 within at least one of said plurality of heavy weight sections.

12. The method of claim 10, further comprising when said drilling weight on said drilling bit during drilling is greater than 10,000 pounds then said length of said bottom hole assembly in compression is less than twenty-five feet.

13. A plurality of heavy weight sections for a bottom hole drilling assembly, said bottom hole drilling assembly being utilized for drilling a bore hole through an earth formation, said bottom hole drilling assembly being secured to a drill pipe string and being operable for applying a drilling weight to a drill bit for drilling said bore hole such that during drilling then a length of said bottom hole drilling assembly is in tension and a length of said bottom hole assembly adjacent to said drill bit is in compression, said plurality of weight sections comprising:

a plurality of connections which connect between said plurality of heavy weight sections:

a plurality of slidable members connected to transfer force through said plurality of connections, whereby when said drilling weight on said drilling bit during drilling is greater than 10,000 pounds then said length of said bottom hole assembly in compression is less than fifty feet.

14. The plurality of heavy weight sections of claim 13, further comprising at least one high density weight section positioned with at least one of said plurality of heavy weight sections which comprises a specific gravity greater than 10.0.

15. The plurality of heavy weight sections of claim 13, further comprising that plurality of slidable members connected to transfer force through said plurality of connections whereby when said drilling weight on said drilling bit during drilling is greater than 10,000 pounds then said length of said bottom hole assembly in compression is less than twenty-five feet.

* * * * *